US006053598A

United States Patent [19]

Inpyn

[11] Patent Number: 6,053,598

[45] Date of Patent: Apr. 25, 2000

[54] MULTIPLE PRINT HEAD PACKAGING FOR INK JET PRINTER

[75] Inventor: Bruce Inpyn, Hamden, Conn.

[73] Assignee: Pitney Bowes Inc., Stamford, Conn.

[21] Appl. No.: 08/421,651

[22] Filed: Apr. 13, 1995

[51] Int. Cl.[7] ..... B41J 2/14; B41J 2/16

[52] U.S. Cl. ..... 347/49; 347/50

[58] Field of Search ..... 347/42, 43, 49, 347/50

[56] References Cited

U.S. PATENT DOCUMENTS

| | | | |
|---|---|---|---|
| 4,271,589 | 6/1981 | Gudorf | 29/878 |
| 4,347,522 | 8/1982 | Bahl et al. | 346/75 |
| 4,421,706 | 12/1983 | Feenstra et al. | 264/157 |
| 4,580,148 | 4/1986 | Domoto et al. | 346/140 R |
| 4,755,836 | 7/1988 | Ta et al. | 346/140 R |
| 4,789,871 | 12/1988 | Uddgren | 346/75 |
| 4,791,440 | 12/1988 | Eldridge et al. | 346/140 R |
| 5,189,437 | 2/1993 | Michaelis et al. | 29/878 |

FOREIGN PATENT DOCUMENTS

| | | | |
|---|---|---|---|
| 0 571 804 A2 | 5/1993 | European Pat. Off. | B41J 2/155 |
| 2 134 045 | 8/1984 | United Kingdom | B41J 3/04 |

*Primary Examiner*—Safet Metjahic
*Assistant Examiner*—Christopher Mahoney
*Attorney, Agent, or Firm*—Angelo N. Chaclas; Michael E. Melton

[57] ABSTRACT

An improvement in an ink jet digital printing device is disclosed which permits the printing device to print an image on a moving image receiving medium which is laterally larger than the length of the ink jet nozzle array on the nozzle plate of a standard ink jet print head, and to do so during only one pass of the image receiving medium relative to the print head. This is accomplished by providing the improved print head with a plurality of nozzle plates disposed on a face of the print head, each nozzle plate having an identical array of apertures defining nozzles for ejecting ink on the ink receiving medium, and arranging the nozzle plates in such a manner that the arrays of apertures for each nozzle plate form a continuous printing line across the face of the print head in the direction of alignment of the arrays of apertures. By appropriately controlling the activation of ink ejection devices associated with all of the apertures, an image can be printed on the image receiving medium having a lateral dimension equal to the continuous printing length of all of the arrays of apertures on the plurality of nozzle plates.

11 Claims, 17 Drawing Sheets

MULTIPLE PRINT HEAD PACKAGING FOR INK JET PRINTER

BACKGROUND OF THE INVENTION

The present invention relates generally to the field of ink jet printing, and more particularly to an ink jet printer in which a plurality of commercially available ink jet printing heads are arranged or packaged in a manner which permits them to print an image of larger height than can be produced from a single print head.

In recent years ink jet printers have achieved significant popularity in various fields, particularly in the areas of desk top printing, such as computer printers, and other forms of convenience printing devices where the charateristics of major importance are convenience of printing from a small, easily movable, device having reasonably good speed and clarity of printed image. Perhaps the most popular and well known of these printing applications is that of ink jet printers for use with desk top computers, particularly those used in the home, where relatively low cost is another factor that contributes to the popularity of ink jet printers. However, technology is constantly improving the desirable characteristics of ink jet prirters and rendering them adaptable to a greater variety of applications, as a result of which additional demands are placed upon the technology by applications for these printers not anticipated during early stages of development.

A brief review of the underlying principles of operation of ink jet printers will facilitate a better understanding of the problems of using an ink jet printer in one of the aforementioned new applications. A simple ink jet printer consists of a print head having a suitable reservoir for holding a supply of ink, and a nozzle plate having a row of extremely small diameter holes or nozzles through which the ink is expelled onto a piece of paper as the print head moves across the paper. There are suitable conduit means for providing communication between the ink reservoir and each of the nozzles, and a minute resistance heater is positioned in each conduit so that when heated momentarily, it volitilizes the liquid ink that is adjacent to the heater to create a small babble, which in turn generates sufficient pressure in the conduit to force a minute droplet of ink from the nozzle associated with that heater. The heaters in all of the conduits are energized from a suitable power source in a predetermined sequence under the control of suitable software with the result that the droplets of irk ejected from the nozzles form a desired image on the piece of peiper as the print head moves across the paper. It will be apparent, of course, that in normal operation of the ink jet printer, the rate of sequential energization of the heaters and consequent ejection of ink jets from the nozzles is extremely rapid, a factor which is primarly responsible for the relatively rapid printing raite of these printers.

Ink jet printers were originally conceived and subsequently developed primarily to reproduce text and graphic images to accommodate the requirements of what is now commonly referred to as desktop publishing. In this field, the typical mode of operation of an ink jet printer was to print a line of text during one pass of the print head past the piece of paper. To do this, the ink nozzles were arranged in a pair of rows, usually extending about one quarter of an inch, the nozzles of one row being longitudinally offset very slightly from the nozzles of the other row and being spaced sufficiently close together to form a substantially solid line if all of the nozzles expelled a droplet of ink simultaneously. This configuration is generally the standard form of monochrome ink jet printing head incorporated in present day commercially available printers.

A significant problem inherent in printers as just described is that the vertical height of the printed image is limited to the corresponding length of the row of nozzles on the printing face, which, as previously stated, is about one quarter inch. While approximately one quarter inch height is entirely satisfactory for ordinary printed text, there are many situations in which such images as text headings and graphic materials exceed this height. In current ink jet printing technology, the dimensional limitation problem is circumvented by printing a portion of an image during one pass of the print head across the paper, and then indexing the paper to change its longitudinal relationship with the print head, and then printing the rest of the image during a second pass of the print head across the paper. If the image is sufficiently tall that it cannot be printed in two passes of the print head, then a third or ever subsequent passes may be required to print the entire image. It should be noted parenthetically that although reference has been made to moving the print head across; the piece of paper, this is not always the case, since in some printers the print head is maintained stationary, and the piece of paper is mounted for lateral movement in the printing device and moves with respect to the print head. All that is required in operation is relative movement between the paper and the print head.

It will immediately be recognized that there are several problems of differing degrees of severity involved in printing an image, whether text or graphics, in more than one pass of either the paper or the print head to print the entire image. One is the increased complexity of the software program that must fragment an image into horizontal sections and cause the print head to print the entire image in a plurality of horizontal sections. Another is the increased mechanical and electrical complexity of the paper feed mechanism in printers where the paper is moved relative to the print head during printing by now having to index the paper one printing line at a time in a direction perpendicular to the direction of printing.

However, a major problem encountered in situations where a graphic image is too tall to be printed in one pass of the paper or the print head, as the case may be, is where, for one reason or another, it is physically impossible to achieve more than one pass of the paper or the print head, with the result that if the image cannot be printed in one pass, it simply cannot be printed. This is the case with the printing application to which the present invention is related, which is the field of mailing machines. As is fairly well known, a mailing machine consists of a feed deck and a postage meter which includes a printing device for printing a postage indicia on the upper right hand corner of an envelope being fed through the mailing machine by suitable feeding means. Typically, printing is accomplished by passing the envelope between a curved printing die carried by a rotating drum and a backup pressure roller, during which ink previously applied to the printing die by a suitable inking device is transferred to the envelope, after which it is ejected from the mailing machine. In another mode, the envelope is pressed against a previously inked flat die by a moving platen to transfer the ink from the die to the envelope, after which it is ejected from the mailing machine. It is apparent that with either type of die, the image of the postage indicia, and often an accompanying advertising slogan, can be made to any desired size, which is limited only by the physical dimensions of the dies for the postage indicia and advertising slogan, and the envelope size, with the result that the entire image can be printed in one pass through the mailing machine.

Thus, there is a need for a technique for printing large dimension images, whether of text or graphics or both, by means of an ink jet digital printing apparatus in which the full height of the image can be printed during only one pass of the print head over the paper, or the paper over the print head, as the case may be.

BRIEF SUMMARY OF THE INVENTION

The present invention greatly obviates if not entirely eliminates the foregoing problems inherent in printing an oversized image utilizing digital ink jet technology by provding a novel packaging arrangement for a plurality of ink jet nozzle plates on a single print head, which are arranged on a face of the print head in such an a manner that the plurality of nozzle plates can print an image that is larger in a lateral dimension than the physical length of the arrangement of nozzles on a single nozzle plate.

In its broader aspects, the present invention is utilized in combination with an ink jet digital printing device which includes a print head having a housing which defines a reservoir for holding a supply of ink and an ink ejecting assembly affixed to one face of the housing for ejecting minute droplets of ink from the reservoir onto an image receiving medium having relative movement with respect to said print head. The ink ejecting assembly including a nozzle plate having an elongate array of aligned apertures which define nozzles through which th(e ink is ejected onto the image receiving medium, means defining a plurality of channels which communicate between the ink reservoir and the nozzles, and ink ejecting means operatively associated with each of the channels for ejecting a minute droplet of ink through the nozzles in response to an electric current being applied to the ink ejecting means. There is a plurality of adjacent electric contacts formed on opposite edges of the ink ejecting assembly and connected to the ink ejecting means, and a plurality of electrical traces disposed on the housing and connected to the contacts for conducting the electric current to each of the ink ejecting means. In this environment, the invention is the improvement in the print head which comprises a plurality of the ink ejecting assemblies affixed to the housing, each of the ink ejecting assemblies having the nozzle plate with the elongate array of aligned apertures thereon, the ink ejecting assemblies being oriented on the face of the housing such that a longitudinal projection of the arrays of apertures on all of the plurality of ink ejecting assemblies forms a continuous image extending from the outer end of one outermost array of apertures to the opposite outer end of the other outermost array of apertures. The electrical traces for each of the ink ejecting assemblies are disposed on the face of the housing so as to communicate with the electric contacts on the opposite Edges of the ink ejecting assemblies, with the result that when the print head and the image receiving medium are moved relative to one another during a printing operation of the digital printing device, an image can be printed during a single pass of the relative movement which is higher than the length of a single one of the elongate arrays of aligned apertures.

In some of its more limited aspects, the plurality of ink ejecting assemblies are oriented on the face of said housing in laterally and longitudinally offset relationship with respect to the direction of the relative movement between the print head and the image receiving medium.

In the simplest form of the invention, there are two ink ejecting assemblies disposed in the laterally and longitudinally offset relationship, and the electrical traces for both of the ink ejecting assemblies extend from the plurality of electric contacts on opposite sides of both of the ink ejecting assemblies to a single contact pad disposed on a lateral side of the housing relative to the direction of relative movement between the print head and the image receiving medium. This form of the invention, however, has the limitation that a print head having this arrangement of ink ejecting assemblies cannot print an image that is higher than twice the length of the array of apertures on a standard ink ejecting assembly.

Larger images can be printed by providing additional ink ejecting assemblies, and in a further embodiment of the invention, there are three ink ejecting assemblies oriented such that two of them are disposed adjacent one another so that the array of apertures on each of the two ink ejecting assemblies are in linear alignment across the face of the housing laterally of the direction of relative movement, and a third ink ejecting assembly is disposed in offset relationship to the two ink ejecting assemblies longitudinally of the direction of relative movement. The electrical traces for all three ink ejecting assemblies extend from the plurality of electric contacts on opposite edges of the three ink ejecting assemblies to a single contact pad disposed on a lateral side of the housing relative to the direction (of relative movement.

Several additional embodiments of the invention are described hereinbelow, which show another arrangement of the ink ejecting assemblies on the face of the housing in which they are oriented in a diagonal relationship across the face of the housing, and also which show other arrangements of extending the traces from the ink ejecting assemblies to opposite lateral sides of the housing and to one or both longitudinal sides thereof, as well as different configurations of the flex tape on which the electrical traces are formed.

Having briefly described the general nature of the present invention, it is a principal object thereof to provide an improvement in the print head of a digital ink jet printing device which enhances the construction of the print head so that the printing device performs a printing operation not possible with presently available ink jet print heads.

It is another object of the present invention to provide an improvement in the print head of a digital ink jet printing device which permits the printing device to print an image having a lateral dimension that is larger than the length of the array of ink jet nozzles on the nozzle plate of a standard ink jet print head.

It is still another object of the present invention to provide an improvement in the print head of a digital ink jet printing device which achieves the foregoing objects without the necessity for a major redesign of presently available ink jet print heads, thereby permitting presently available ink jet printers to incorporate the advantages of the present invention without substantial redesign of the printers.

These and other objects and advantages of the present invention will be become more apparent from an understanding of the following detailed description of a presently preferred mode of carrying out the invention, when considered in conjunction with the accompanying drawings.

DETAILED DESCRIPTION OF THE INVENTION

Figure 1:
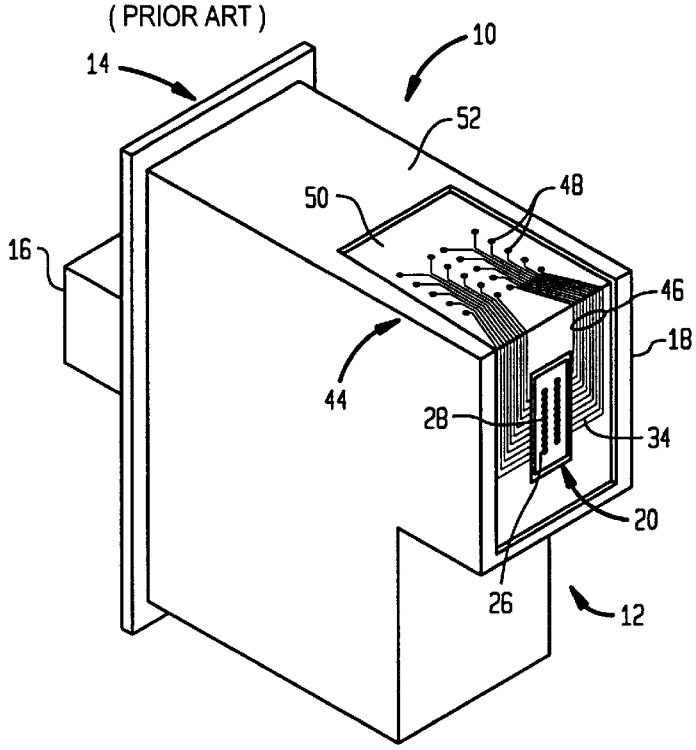
FIG. 1 ( PRIOR ART )
FIG. 1 is a perspective view of a typical presently available ink jet print head utilized in digital ink jet printers.

It will facilitate an understanding of the present invention to describe briefly one type of ink jet print head with which the present invention can be utilized. Thus, with reference to FIGS. 1 to 4 of the drawings, there is seen a typical ink jet print head, designated generally by the reference numeral 1C, which is part of a digital ink jet printing device, of which there are many types commercially available. The print head 10 includes a housing, designated generally by the reference numeral 12, which includes a suitable reservoir for a supply of ink, and a cover assembly, designated generally by the reference numeral 14, which provides a closure for the housing and a mounting means for a suitable handle 16 by which the print head 10 is held for inserting the print head 10 into and removing it from the digital printing device.

Figure 3:
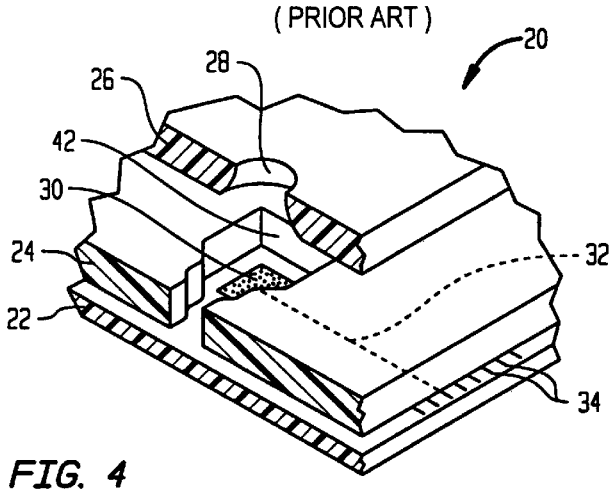
FIG. 3 ( PRIOR ART )
FIG. 3 is a fragmentary perspective sectional view through a portion of the ink ejecting assembly of the print head shown in FIG. 1.
Figure 4:
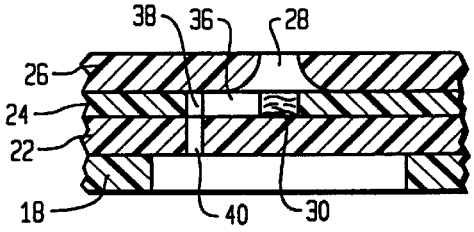
FIG. 4 ( PRIOR ART )
FIG. 4 is a fragmentary elevational sectional view through the same portion of the ink ejecting assembly as shown in FIG. 3.

The housing 12 includes a bottom wall 18 which is adapted to be disposed closely adjacent to an image receiving medium when the print head is operatively mounted in the digital printing device, so that, as will be seen in more detail hereinafter, when the print head is in operation, ink from the reservoir in the housing 12 can be deposited very accurately on the image receiving medium. To this end, the print head 10 includes an ink ejecting assembly, designated generally by the reference numeral 20, suitably affixed to the bottom wall 18, which, as best seen in FIGS. 3 and 4, includes a silicon substrate 22 which is initially covered with a layer of conductive material, a polymer layer 24, and a nozzleplate 26. The silicon layer 22 has a plurality of electrical circuits formed thereon by any of a number of suitable processes, such as plating, etching, or deposition, which patterns the conductive layer on the surface of the silicon substrate in the areas in which the photosensive polymer layer 24 is patterned in accordance with the desired configuration of the electrical circuits to be placed on the substrate, in a manner well. known in photoetching technology.

Figure 2:
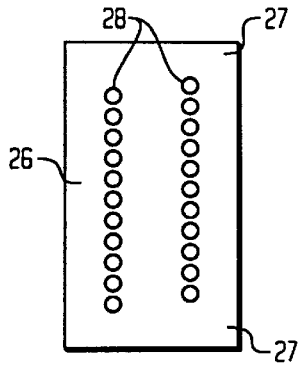
FIG. 2 ( PRIOR ART )
FIG. 2 is a plan view, drawn to an enlarged scale, of the nozzle plate which is part of the ink ejection assembly of the print head shown in FIG. 1

The ink ejecting assembly 20 also includes a nozzle plate 26 disposed on top of the remaining portions of the photosensitive polymer layer 24, the nozzle plate 26 being a very thin piece of metal having a pair of spaced parallel elongate arrays of aligned apertures 28 which form nozzles through which ink is ejected in minute droplets to be deposited on the image receiving medium as further explained below. Although it is possible to have only one array of apertures in the nozzle plate 26, it is preferable for better quality printing to have a pair of arrays of apertures, as seen in FIG. 2, with the apertures in each array being slightly offset in the longitudinal direction of the arrays, so that ink from each array fills the voids left by the other array due to the minute portion of the nozzle plate 26 between each aperture. As best seen in FIG. 2, the arrays of apertures 28 do not extend to the adjacent edges of the nozzle plate 26, since it is necessary to have a border portion 27 of the nozzle plate 26 disposed beyond the last of the apertures 28 to provide sufficient strength and regidity to the nozzle plate 26 for handling. Without these border portions 27 the two halves of the nozzle plate 26 would simply fragment.

The aforementioned electrical circuits formed an the silicon substrate 22 include a plurality of very small thin film resistance heaters 30, and trace lines 32 running along the surface of the silicon substrate 22 to an edge thereof at which they terminate in a plurality of contacts 34 lying on the surface of the silicon substrate 22. Also, a plurality of channels 36 are formed in the polymer layer 24, one for each of the trace lines 30, which communicate with a laterally extending man-fold 38 also formed in the photosensitive polymer layer 24, and which, in turn, communicates with a channel 40 extending through the silicon substrate 22 and opening into the ink containing reservoir within the housing 12. The end portion of each channel 36 which lies directly over the resistance heater 30 constitutes a chamber 42 in which a minute amount of ink is instantly vaporized when the heater 30 is energized by the application of an electric current. This creates a bubble in the ink which exerts sufficient force on the ink in the chamber directly below the orifice opening to eject a small droplet through the adjacent nozzle 28.

In a manner well known in the art, the electric current required to energize the heaters 30 is provided by flexible circuit, designated generally in FIG. 1 by the numeral 4,4, which consists of a strip of suitable polyimide film which supports a plurality of electrical traces 46, each of which is connected at one end to one of the contacts 34 on the silicon substrate 24 and at the other end to one of a plurality of contacts 48 disposed on a contact pad 50 affixed to a side surface 52 of the housing 12. The contacts 48 are adapted to make contact with suitable circuitry in the digital printing device by which the heaters 30 are energized in accordance with a sequence controlled by the system software of the digital printing device through suitable control electronics.

From the foregoing description, the problem of printing images which are larger in lateral dimension than the length of the array of apertures on the nozzle plate should now be fully understood. As best seen in FIGS. 1 and 2, the array of apertures 28 in the nozzle plate 26 may vary in length somewhat from one manufacturer to another, but generally is approximately 25 inch, which is the maximum length of a continuous lateral line that can be printed by the print head 10 during a single pass of the print head 10 across an image receiving surface, or a single pass of the imaging receiving surface relative to a stationary print head 10, as the case may be. Thus, it is impossible with a standard print head such as that illustrated in FIG. 1 to print in one pass an image that is taller than the length of a single array of apertures 28.

The present invention effectively solves this problem by providing a print head having a plurality of ink ejecting assemblies suitably affixed to the print head and oriented in such a manner that a longitudinal projection of the arrays of apertures on all of the ink ejecting assemblies forms a continuous image extending from the outer end of one outermost array of apertures to the opposite outer end of the other outermost array of apertures. This is accomplished in the simplest embodiment of the present invention by providing a minimum of two ink ejecting assemblies which are offset both laterally and longitudinally with respect to the direction of relative movement between the print head and the image receiving medium during a printing operation so that a longitudinal projection of the arrays of apertures on both of the ink ejecting assemblies forms a continuous image extending from opposite outer ends of the two arrays of apertures. In further embodiments of the invention, additional ink ejecting assemblies are added in an offset manner, both the number of ink ejecting assemblies and the manner in which they are offset varying in accordance with the desired height of the printed image and also with regard to the desired location or locations of the electric contact pads for the flexible circuits required for each ink ejecting assembly.

In order to facilitate clarity of description, it should be understood that throughout the following description of the invention and in the appended claims, the word "lateral" means perpendicular to the direction of relative movement between the print head 10 and the image receiving medium, as indicated in the figures by the double ended arrow A, and the word "longitudinal" means parallel to the direction of relative movement between the print head 10 and the image receiving medium.

Figure 5:
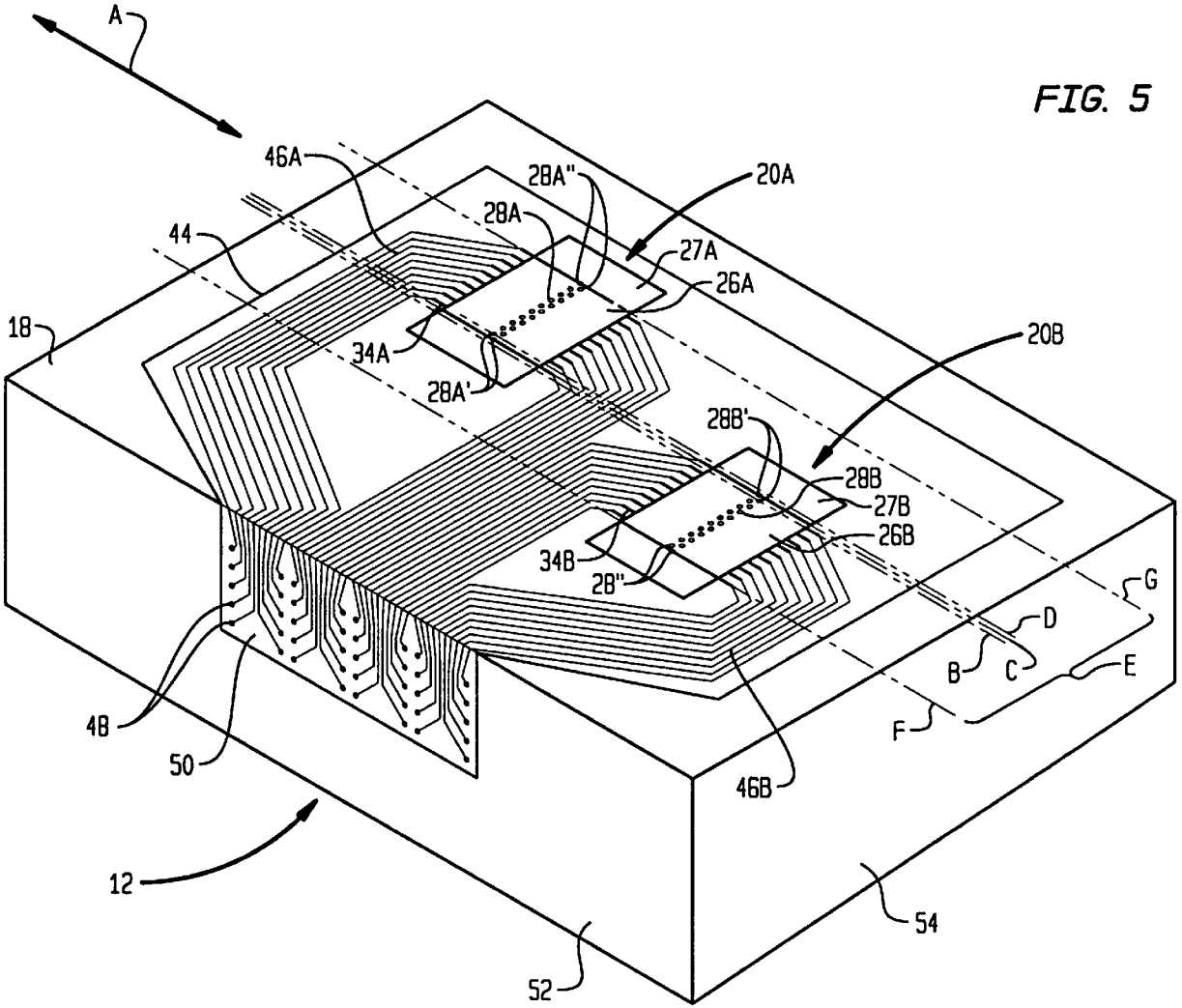
FIG. 5 is a perspective view, drawn to a greatly enlarged scale, of the surface of the print head shown in FIG. 1 which illustrates one embodiment of the invention in which there are two ink ejecting assemblies, and the electrical traces extend to one lateral side of the housing.
Figure 6:
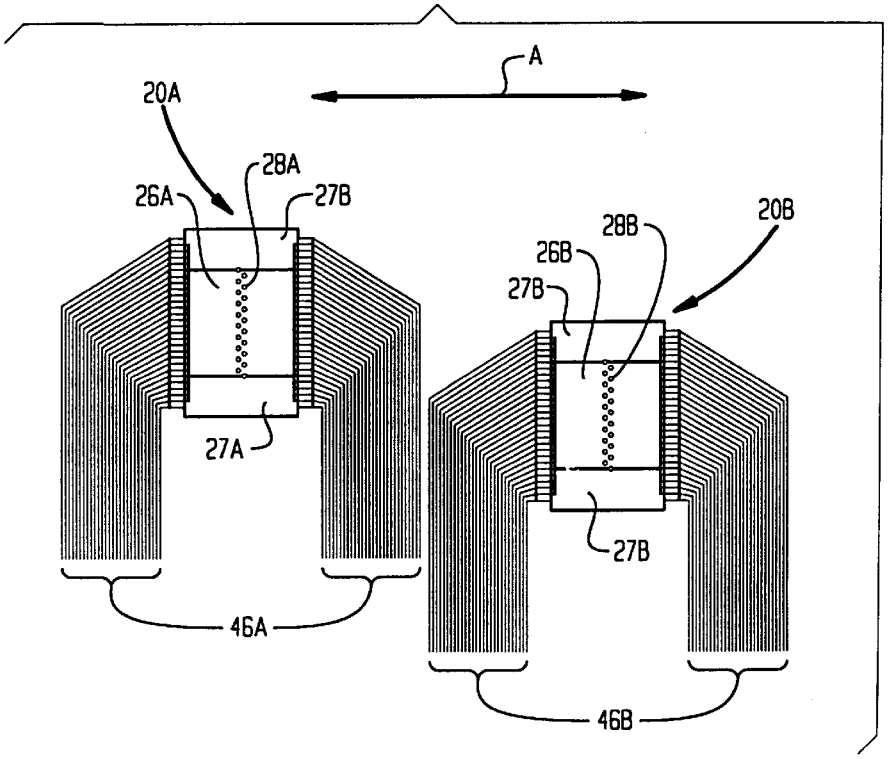
FIG. 6 is a plan view of the arrangement of ink ejecting assemblies and electrical traces shown in FIG. 5.

The embodiment illustrated in FIGS. 5 and 6 represents the simplest form of the invention, and in FIG. 5., the portion of the housing 12 that includes the bottom wall 18 is shown in an inverted position for clarity of illustration. It is seen that there are two ink ejecting assemblies 20A and 20B, which are disposed in laterally and longitudinally offset relationship with respect to the direction of relative movement between the print head 20 and an image receiving medium during a printing operation, this direction of relative movement being indicated by the double ended arrow A. Each ink ejection assembly has a nozzle plate 26A and 26B, and each nozzle plate 26A has at least one array of aligned apertures 28A and 28B, but more preferably a pair of elongate arrays of aligned apertures 28A and 28B respectively, FLS illustrated in FIG. 2, which are bordered on opposite ends by border portions 27A and 27B of the nozzle plates 26A and 26B, and which define the nozzles 28 for each nozzle plate through which ink is ejected during a printing operation. Each ink ejection assembly 20A and 20B has a plurality of electrical traces 46A and 46B formed on a single strip of a flexible circuit 44, the traces 46A and 46B extending from contacts 34A and 34B on opposite sides of the ink ejecting assemblies 20A and 20B respectively, to corresponding electric contacts 48 on the contact pad 50 disposed on the lateral side 52 of the housing 12.

As best seen in FIG. 5, the ink ejecting assemblies 20A and 20B are offset laterally of the direction of relative movement sufficiently far that the border portions 27A and 27B of both nozzle plates 26A and 26B overlap far enough to disposes the adjacent end apertures 28A' and 28B' of each array of apertures on each nozzle plate the same distance apart as all other adjacent apertures on both arrays. This aperture spacing is indicated by the lines B and C, which represent the longitudinal projection of the adjacent end apertures 28A' and 28B' for the right hand row of apertures in each array, and the lines C and D, which represent the longitudinal projection of the adjacent end apertures 28A' and 28B' for the left hand row of apertures, respectively. Thus, the longitudinal projections of all of the apertures 28 in the arrays of apertures 28A and 28B form a continuous image, as indicated by the bracket E, which extends from the opposite outermost end aperture of each of the pairs of end apertures 28B" and 28A" of both arrays of apertures, the positions of these end apertures being indicated the lines F and G which represent the longitudinal projection of these outermost end apertures. Thus, the arrangement of ink ejecting assemblies in this embodiment will enable the digital printing device to print an image during a single pass of relative motion between the print head 10 and the image receiving medium that has a lateral dimension double the length of the arrays of apertures on a standard commercially available print head.

As seen in FIGS. 5 and 6, all of the traces 46A and 46B extend from opposite sides of the respective ink ejecting assemblies 20A and 20B toward the single contact pad 50 disposed on the lateral side 52 of the housing 12. The advantage of this arrangement is the convenience of electrical connection with corresponding connections in the digital printing device in which the print head 10 is mounted, in that the print head 10 can be inserted into and removed from a suitable mounting in the printing device by a simple unidirectional movement which brings the contact pad 50 into engagement with a similar contact pad in the printing device. One disadvantage of this arrangement is that sufficient space is required between the ink ejecting assemblies 26A and 26B to accommodate the necessary width of all of the traces 46A and 46B.

It will be readily understood after considering the following description of other embodiments and variations thereof that it is within the scope of the invention to provide alternate variations of the embodiment illustrated in FIG. 5 in which the electrical traces 46A and 46B of the ink ejection assemblies 20A and 20B can extend to a single longitudinal side 54 of the housing 12, or to opposite lateral sides or opposite longitudinal sides of the housing 12. These variations are fully described below in connection with subsequent embodiments of the invention which utilize three ink ejection assemblies, which is the preferred arrangement, and it is not deemed necessary to repeat this description in connection with the simplified embodiment of the invention illustrated in FIG. 5.

Figure 8:
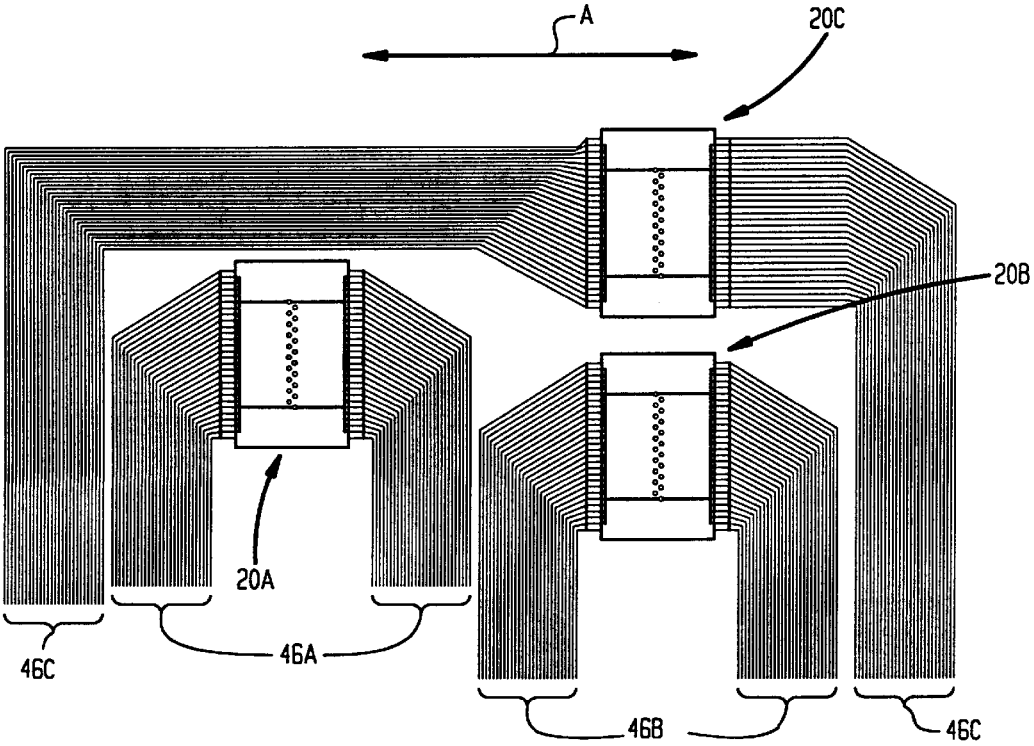
FIG. 8 is a plan view, similar to FIG. 6, of the variation shown in FIG. 7.
Figure 7:
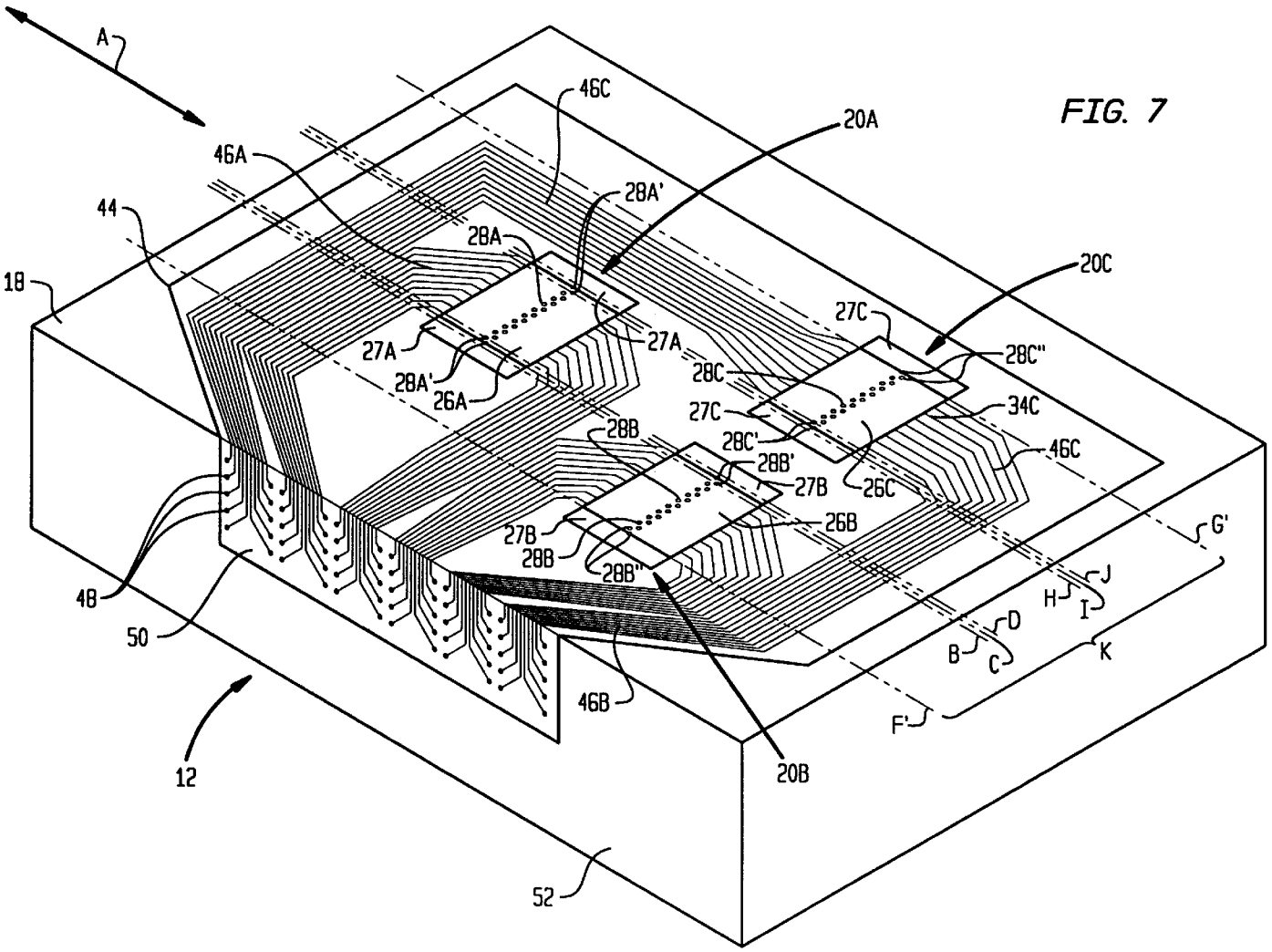
FIG. 7 is a perspective view, similar to FIG. 5, of one variation of another embodiment of the invention in which there are three ink ejecting assemblies, and the electrical traces for all three ink ejecting assemblies extend to the same lateral side as in the embodiment shown in FIG. 5.

FIGS. 7 and 8 illustrate one variation of another embodiment of the invention which is similar to that shown in FIGS. 5 and 6, but which includes a third ink ejecting assembly 20C that extends the lateral dimension of an image which can be printed in one pass of relative movement to up to three times the length of the arrays of apertures on a standard commercially available print, head. The ink ejecting assemblies are oriented such that two of the assemblies are disposed adjacent one another in laterally side by side relationship so that the arrays of apertures are in linear alignment across the face 18 of the housing 12, and the third ink ejecting assembly is disposed in offset the same laterally and longitudinally offset relationship to the ink ejecting assembly as it was in the previous embodiment.

Thus, the ink ejection assembly 20C has a nozzle plate 26C which has at least one array of aligned apertures 28C, but more preferably a pair of elongate arrays of aligned apertures 28C, again as illustrated in FIG. 2, which are bordered on opposite ends by border portions 27C, and which define the nozzles 28 for the nozzle plate 26C through which ink is ejected during a printing operation. The ink ejection assembly 20C has a plurality of electrical traces 46C formed on a the same single strip of flexible circuit 44 as the electrical traces 46A and 46B for the ink ejecting assemblies 20A and 20B, the traces 46C extending from contacts 34C on opposite sides of the ink ejecting assembly 20C, to the same electric contact pad 50 disposed on the lateral side 52 of the housing 12 as for the traces 46A and 46B.

The ink ejection assembly 20C is oriented such that it is offset laterally of the direction of relative movement indicated by the arrow A with respect to the ink ejection assembly 202, but is offset longitudinally of that direction with respect to the ink ejection assembly 20A, such that the arrays of apertures 28C on the ink ejecting assembly 20C are in adjacent linear alignment across the face 18 of the housing 12 with the corresponding arrays of apertures 28B on the ink ejecting assembly 20B. As: in the previous embodiment with respect to the ink ejecting assemblies 20A and 20B, the ink ejecting assembly 20C is also offset laterally with respect to the ink ejection assembly 20A sufficiently far that the border portions 27A and 27C of both nozzle plates 26A and 26C overlap far enough to dispose the adjacent end apertures 28A' and 28C' of each array of apertures on each nozzle plate the same distance apart as all other adjacent apertures on both arrays. In the same manner as that described above for the adjacent pair of apertures 28A' and 28B', as indicated by the lines B, C and D in FIG. 5, the aperture spacing for the adjacent pairs of apertures 28A' and 28C' are indicated by the lines H and I, which represent the longitudinal projection of the adjacent end apertures 28A' and 28C' for the right hand row of apertures in each array, and the lines I and J, which represent the longitudinal projection of the adjacent end apertures 28A' and 28C' for the left hand row of apertures, respectively. Thus, the longitudinal projections of all of the apertures 28 in the arrays of apertures 28A, 28B and 28C form a continuous image, as indicated by the bracket K, which extends from the opposite outermost end aperture of each of the pairs of end apertures 28B" and 28C" of these arrays of apertures, the positions of these end apertures being indicated by the lines F' and G' which represent the longitudinal projection of these outermost end apertures. Thus, the arrangement of ink ejecting assemblies in this embodiment will enable the digital printing device to print an image during a single pass of relative motion between the print head 10 and the image receiving medium that has a lateral dimension triple the length of the arrays of apertures on a standard commercially available print head.

As seen in FIG. 7, all of the traces 46C extend from opposite sides of the ink ejection assembly 20C toward the single contact pad 50 disposed on one lateral side 52 of the housing 12. The advantages and disadvantages of this arrangement are generally the same as that set forth above in connection with the embodiment shown in FIGS. 5 and 6, with the added disadvantage that additional space is required along the outer longitudinal edges of the flexible circuit 44 to accommodate the traces 46C.

Figure 9:
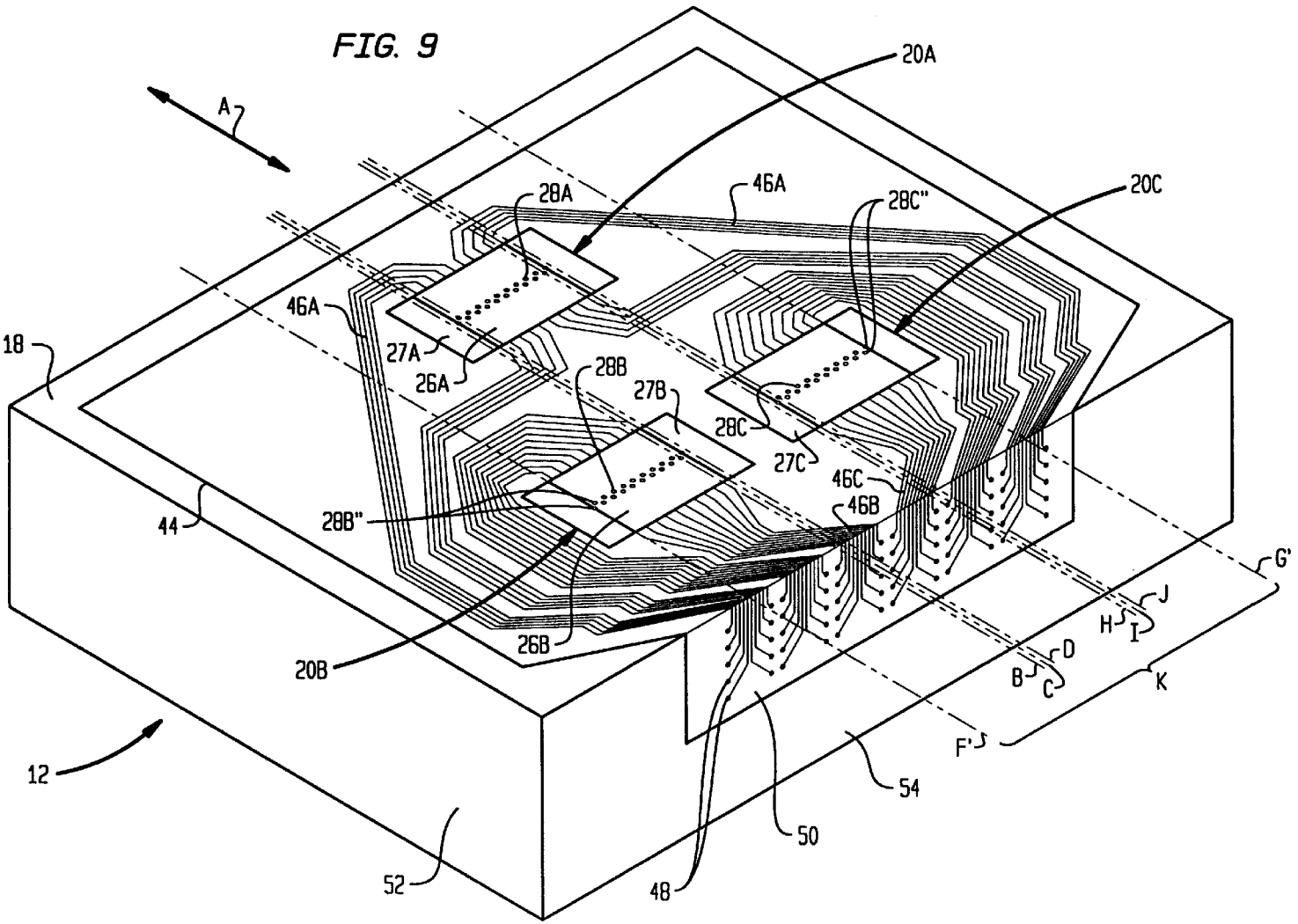
FIG. 9 is a perspective view, similar to FIG. 5, of another variation of the embodiment of the invention shown in FIG. 7 in which the arrangement of ink ejecting assemblies is the same as that for the embodiment shown in FIG. 7, but the electrical traces extend to one longitudinal side of the housing.
Figure 10:
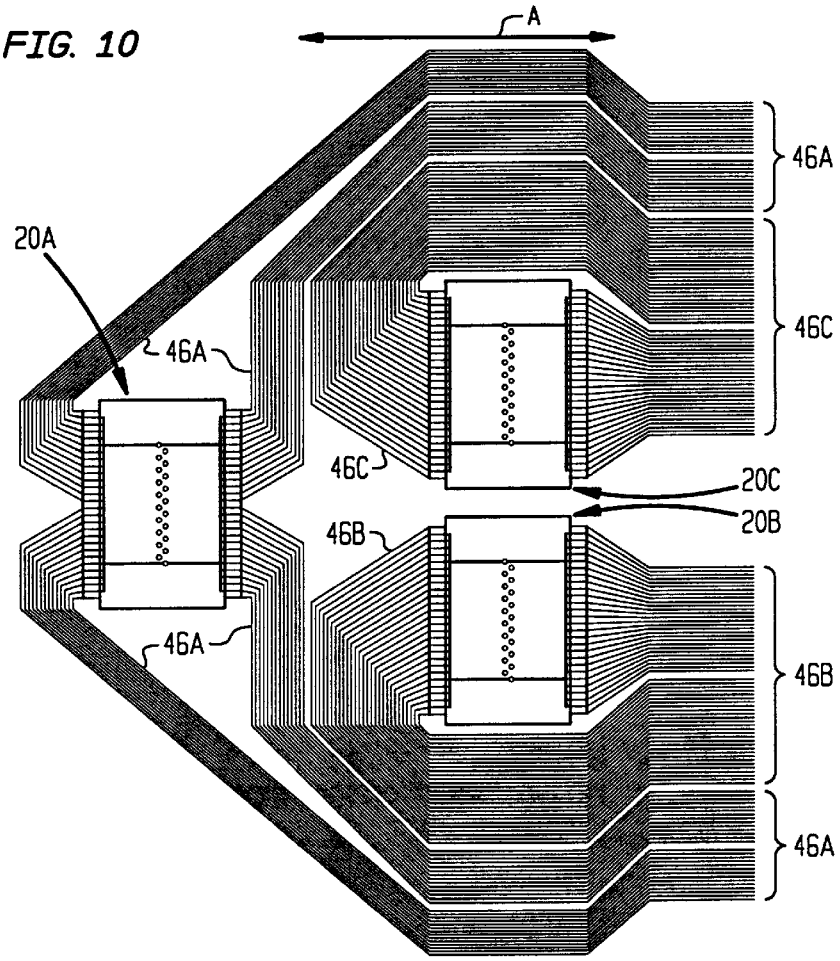
FIG. 10 is a plan view, similar to FIG. 6, of the variation shown in FIG. 9.

FIGS. 9 and 10 illustrate a variation of the embodiment illustrated in FIGS. 7 and 8. In this variation, the laterally and longitudinally offset arrangement of the three ink ejecting assemblies 20A, 20B and 20C, as well as the extent of overlap of the border portions 27A and 272, and 27B and 27C respectively, is the same as in the previous variation. The difference is that the contact pad 50 for the flexible circuit 44 is now located on the longitudinal side 54 of the housing 12 rather than the Lateral side 52. FIGS. 9 and 10 show the direction of the traces 46A, 46B and 46C in extending from the opposite sides of the three ink ejecting assemblies 20A, 20B and 20C to the corresponding contacts 48 on the contact pad 50 disposed on the longitudinal side 54 of the housing 12.

This variation has two significant advantages, the first being the same as that set forth above for the embodiment shown in FIGS. 5 and 6, escept that this arrangement permits the mating contact pad in the printing device to be located adjacent a side edge thereof rather than in an intermediate location as would be required with the previous variation. The other advantage is that the ink ejecting assembly 20A is a little closer to the ink ejecting assembliesx 20B and 20C in the longitudinal direction as represented by the line A than in the case with the variation shown in FIGS. 7 and 8. Generally speaking, it is advantageous with respect to all of the arrangements of the ink ejecting assemblies to have them as close together as possible, since this conserves space on the print head housing and thereby contributes to maintaining the manufacturing cost of the printing device as low as possible because fewer control devices are required than when the ink ejecting assemblies are farther apart. However, a further advantage is realized in that the closer together the ink ejecting assemblies are in the longitudinal direction, the less image distortion is apt to result from any minute variations in the forward speed of a mail piece moving through the digital printing device during an image printing operation. I will be appreciated that physically small packaging is beneficial to the system configuration and it is more user friendly from the standpoint of ease of installation. This variation, on the other hand, suffers the same disadvantage as that for the previous embodiment with regard to the space required between the ink ejecting assemblies 20A and the pair of ink ejecting assemblies 20B and 20C, with the additional disadvantage that more space is required on the flexible circuit 44 along the outer lateral sides thereof to permit the traces 46A to extend to the opposite side 54 of the housing 12 from where the ink ejecting assembly 20A is located.

Figure 11:
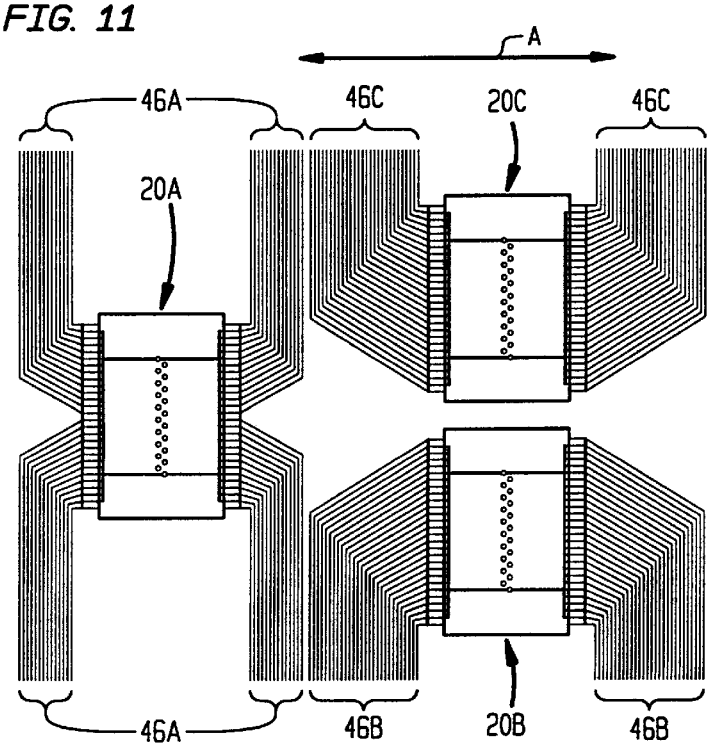
FIG. 11 is a plan view, similar to FIG. 6, of still another variation of the embodiment shown in FIG. 7 in which the number and arrangement of ink ejecting assemblies is the same as that for the variation shown in FIG. 7, but the electrical traces for the ink ejecting assemblies extend to opposite lateral sides of the housing rather than the same lateral side thereof.

FIG. 11 illustrates still another variation of the embodiment illustrated in FIGS. 7 and 8, and for which a further perspective view is not deemed necessary in view of the foregoing description. In this variation, the ink ejecting assemblies 20A, 20B and 20C are oriented the same as for the previous variation, but all of the traces for all three ink ejecting assemblies 20A, 20B and 20C extend to opposite lateral sides of the housing 12, and would terminate on contact pads 50 disposed on both lateral sides. Thus, one half of the electrical traces 46A for the ink ejecting assembly 20A extend to one lateral side of said housing 12, e.g., the lateral side 52 shown in FIG. 7, while the other half of the electrical traces for this ink ejecting assembly extend to the opposite lateral side of the housing 12, although a different allocation of the t races to each side of t he housing 12 could be utilized. Also, all of the lateral traces 46B and 46C of the two adjacent ink ejecting assemblies 20B and 2C extend to the lateral side of the housing 12 that is proximate to each of these two ink ejecting assemblies; i.e., the traces 46B extend to the lateral side 52 closest to the ink ejecting assembly 20B, and the traces 46C extend to the opposite lateral side, since that is the side closest to the ink ejecting assembly 20C.

A principle advantage of this arrangement is that the traces 46A for the ink ejection assembly 20A are divided evenly between the opposite lateral sides of the housing 12, and the traces 46B and the ink ejecting assembly 20B extend to the lateral side 52 (seen in FIG. 9) and the traces 46C for the ink ejecting assembly 20C extend to the opposite lateral side. Thus, all of the traces 46A, 46B and 46C are divided between the opposite lateral sides of the housing 12. The result of this arrangement is that there are two contact pads 50, one on each lateral side of the housing 12, and each contact pad 50 has only one half the number of individual contacts 48 as does the single contact pad 50 when all of the traces extend to one lateral side 52 as seen in FIG.7. Of course, the same contact pad arrangement must be provided in the digital printing device. The reduced contact density on the contact pads diminishes the need for extremely close tolerance control in the manufacture of the contact pads, since each contact 48 can be made larger than with the higher contact density contact pads, thereby reducing the manufacturing costs of the print head. The major disadvantage of this variation, however, is that it becomes necessary to provide a contact means in the digital printing device that engages both lateral sides of the print head 10, which would involve some sort of a clamping arrangement in the printing device for engaging the opposite sides of the housing :.2 after the print head 10 is installed in the printing device.

Figure 12:
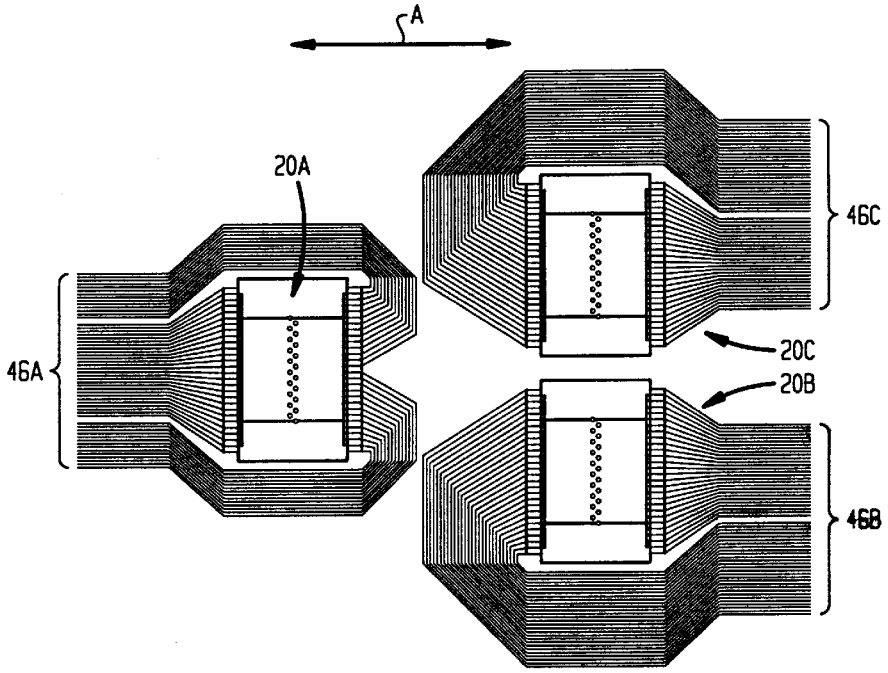
FIG. 12 is a plan view, similar to FIG. 6, but showing a variation similar to that shown in FIG. 11 except that the electrical traces for the ink ejecting assemblies extend to opposite longitudinal sides of the housing rather than to the same longitudinal side thereof.

FIG. 12 illustrates a still further variation on the embodiment shown in FIG. 11, and also for which a further perspective view is not deemed necessary. In this variation, the arrangement of the ink ejecting assemblies 20A, 20B and 20C remains the same, but the traces for all three ink ejecting assemblies extend to opposite longitudinal sides of the housing 12, and would terminate on contact pads 50 disposed on both longitudinal sides. Thus, all of the electrical traces 46A for the ink ejecting assembly 20A extend to one longitudinal side of the housing 12, e.g., the longitudinal side opposite the longitudinal side 54 shown in in FIG. 9, as the trace plan in FIG. 12 is oriented to the perspective view of FIG. 9, while all of the electrical traces 46B and 46C of the two adjacent ink ejecting assemblies 20B and 20C extend to the longitudinal side 54 shown in FIG. 9 that is proximate to the each of these two ink ejecting assemblies. This arrangement has the same advantages as the variation shown in FIGS. 9 and 10 with respect to the longitudinal spacing of the ink ejecting assemblies, and as the variation shown in FIG. 11 with respect to the reduced contact density of the contact pads on opposite sides of the housing. However, this variation suffers the same disadvantage as in the variation shown in FIG. 11 regarding the difficulty in connecting the contact pads on opposite sides of the housing 12 to corresponding contact pads in the digital printing device.

Figure 14:
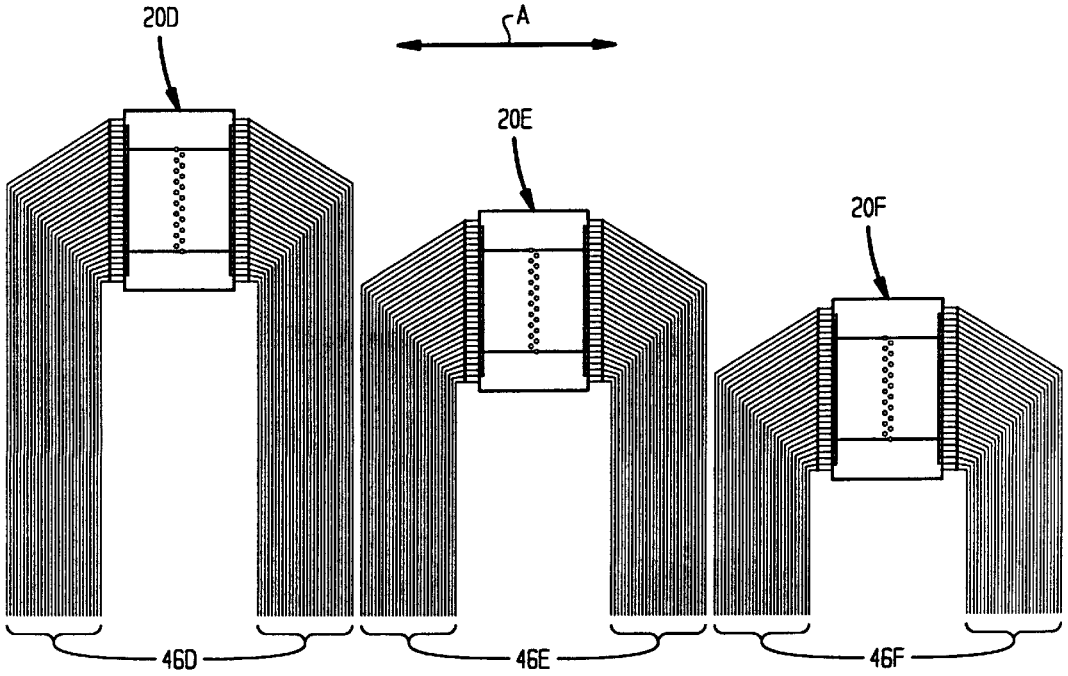
FIG. 14 is a plan view, similar to FIG. 6, of the variation shown in FIG. 13.
Figure 13:
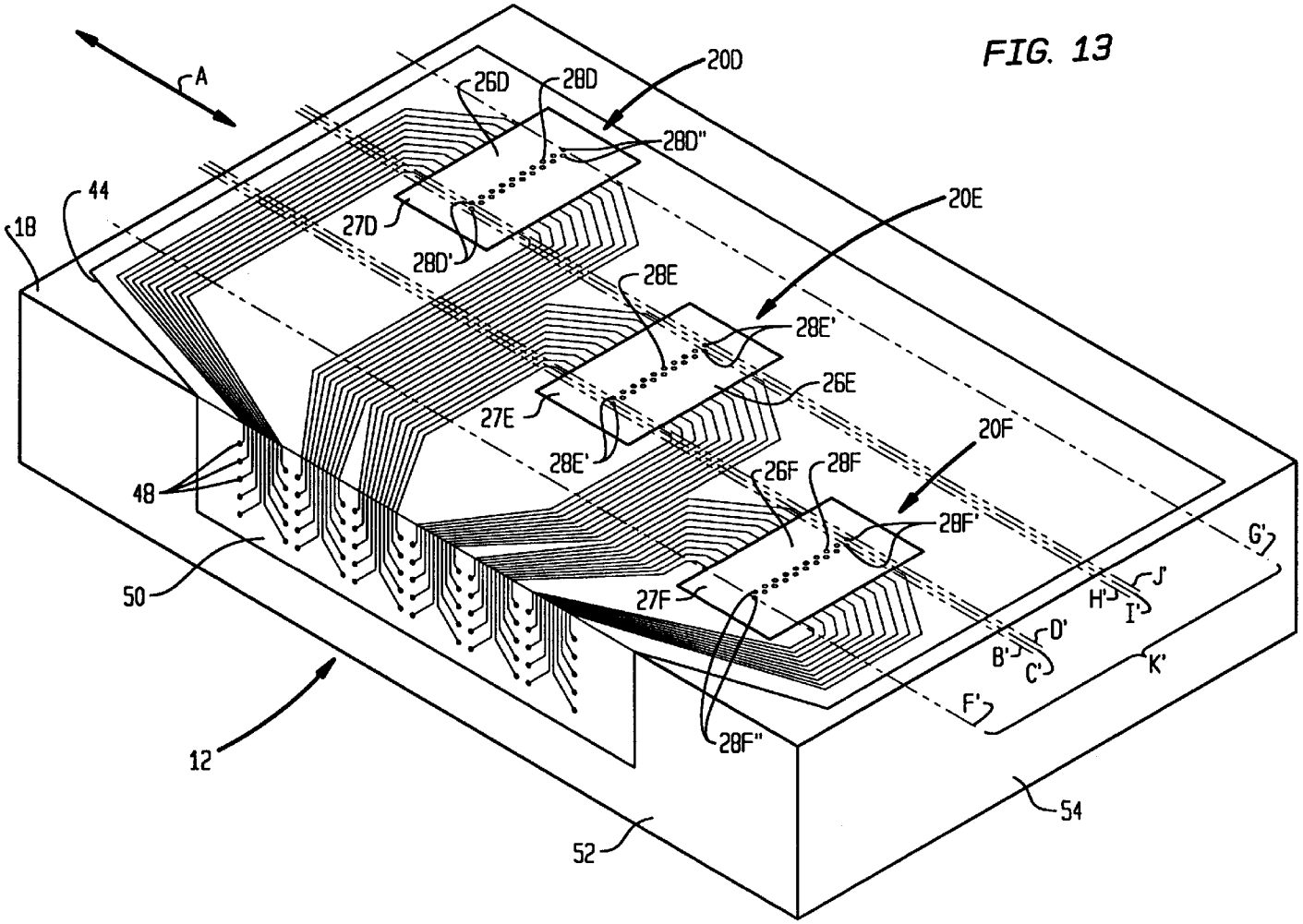
FIG. 13 is a perspective view, similar to FIG. 5, of one variation of still another embodiment of the invention in which the number and arrangement of ink ejecting assemblies is the same as that for the embodiment shown in FIG. 7, but the electrical traces for one ink ejecting assembly extend to one longitudinal side of the housing, and the electrical traces for the two adjacent ink ejecting assemblies extend to the opposite longitudinal side of the housing.

FIGS. 13 and 14 illustrate one variation of still another embodiment of the invention which involves a rearrangement of the ink ejecting assemblies from that shown in the previous embodiments and variations, but which still achieves the advantage of providing a print head that extends the lateral dimension of an image which can be printed in one pass of relative movement to three times the length of the individual arrays of apertures on a standard commercially available print head. In this arrangement, there are three ink ejecting assemblies 20D, 20E and 20F which are arranged in a laterally and longitudinally offset orientation such that they are disposed in diagonal alignment across the face 18 of the housing 12. The ink ejecting assemblies 20D, 20E and 20F are identical to the ink ejecting assemblies 20A, 20B and 20C shown in FIGS. 7 and 9 with respect to both the arrangement of arrays of apertures 28D, 28E and 28F and the extent of overlap of the border portions 27D, 27E and 27F, so that the adjacent pairs of end apertures 28D' and 28E', and 28E' and 28F' respectively, are all the same distance apart.

As in the previous embodiment, the ink ejecting assemblies 20D and 20F are offset laterally with respect to the ink ejection assembly 20E sufficiently far that the border portions 27D and 27F of the nozzle plates 26D and 26F overlap the border portions 27E of the ink ejection assembly 20E far enough to dispose the adjacent end apertures 28D' and 28E', and 28F' and 28E', respectively, of each array of apertures on each nozzle plate the same distance apart as all other adjacent apertures on all three arrays. In the same manner as that described above for the adjacent pair of apertures 28A' and 28B', and 28B' and 28C' respectively, as indicated by the lines B, C and D, and H, I and J in FIGS. 7 and 9, the aperture spacing for the adjacent pairs of apertures 28D' and 28E', and 28E' and 28F', respectively, are indicated by the lines H' and I', which represent the longitudinal projection of the adjacent end apertures 28D' and 28E' for the right hand row of apertures in each array, and the lines I' and J', which represent the longitudinal projection of the adjacent end apertures 28E' and 28F' for the left hand row of apertures, respectively. Thus, the longitudinal projections of all of the apertures 28 in the arrays of apertures 28D, 28E and 28F form a continuous image, as indicated by the bracket K', which extends from the opposite outermost end aperture of each of the pairs of end apertures 28F" and 28D" of these arrays of apertures, the positions of these end apertures being indicated the Lines F' and G' which represent the longitudinal projection of these outermost end apertures. Thus, the arrangement of ink ejecting assemblies in this embodiment will enable the digital printing device to print an image during a single pass of relative motion between the print head 10 and the image receiving medium that has a lateral dimension triple the length of the arrays of apertures on a standard commercially available print head.

As seen in FIG. 14, all of the traces 46D, 46E and 46F extend from opposite sides of the ink ejecting assemblies 20D, 20E and 20F toward the single contact pad 50 disposed on one lateral side 52 of the housing 12. In addition to the advantages of the single laterally disposed contact pad pointed above in connection with the arrangements shown in FIGS. 5 and 7, the major advantage of the diagonally offset arrangement of the ink ejecting assemblies of FIG. 13 over the arrangement shown in FIGS. 7 and 9 is that the former provides better image quality in the event that there is any minute variation in the forward speed of a mail piece through the digital printing device during a printing operation. In the previous arrangement,the ink ejecting assemblies 20B and 20C must print simultaneously since they are in lateral alignment on the surface 18 of the housing 12. If a variation in forward speed of the mail piece occurs while these ink ejecting assemblies are operating, the resulting image will be distorted over that portion of the overall height of the image that is printed by these two ink ejecting assemblies. With the diagonally offset arrangement shown in FIG. 13, it is far less likely that more than one ink ejection assembly will be printing at any given instant, with the result that a minute variation in the forward speed of the mail piece will result in less image distortion. The closer together the ink ejection assemblies are the less image distortion will result.

Another significant advantage of this arrangement is that it is easier to program the digital printing device for the reason that the ink ejecting assemblies operate in sequence from one end to the other, which simplifies the preparation of the software which controls the sequence of operation of the individual ink ejection heaters 30 associated with each of the apertures 28. Still further, less power is required to operate the printing device since the ink ejecting assemblies operate in sequence rather than simultaneously.

The only disadvantage of this arrangement is that the individual ink ejecting assemblies cannot be located as close together as they can with the previous arrangement because of the space require between them to accommodate the traces, which in turn requires more space on the face 18 of the housing 12 to accommodate the amount of flexible circuit 44 necessary to carry all of the traces.

Figure 15:
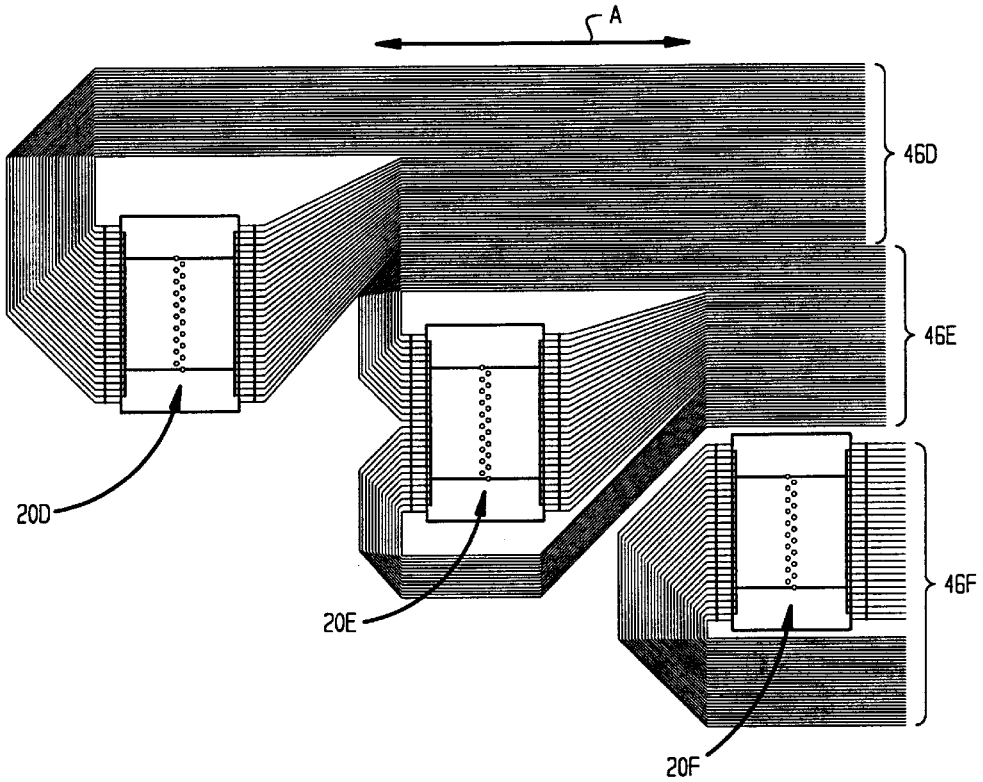
FIG. 15 is a plan view, similar to FIG. a, of another variation of the embodiment shown in FIG. 13, in which the electrical traces for the ink ejecting assemblies extend to the same longitudinal side of the housing.

FIG. 15 illustrates another variation of the embodiment of the invention shown in FIGS. 13 and 14, again for which a further perspective view is not deemed necessary in view of the foregoing description. In this embodiment all of the traces 4ED, 46E and 46F for the ink ejecting assemblies 20D, 20E and 20F extend to the same longitudinal edge of the housing 12, which would be the longitudinal edge 54 shown in FIG. 13 rather than the lateral edge 52. The relative advantages and disadvantages of the arrangement, in addition to those just mentioned regarding the diagonally aligned arrangement of the ink ejecting assemblies 20D, 20E and 20F, are generally the same as those set forth above with respect to the advantages and disadvantages of the arrangement shown in FIG. 9 over that shown in FIG. 7.

Figure 16:
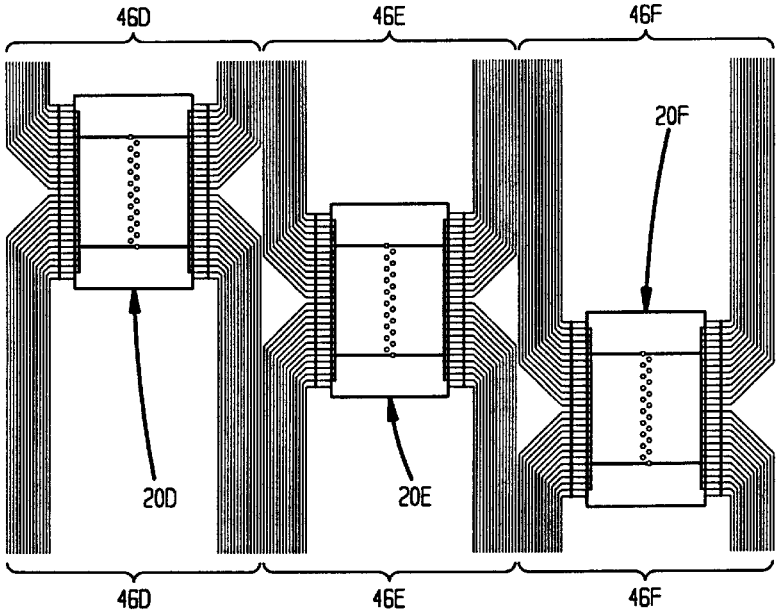
FIG. 16 is a plan view, similar to FIG. 6, of still another variation of the embodiment shown in FIG. 13, in which the electrical traces for the ink ejecting assemblies extend to opposite lateral sides of the housing.
Figure 17:
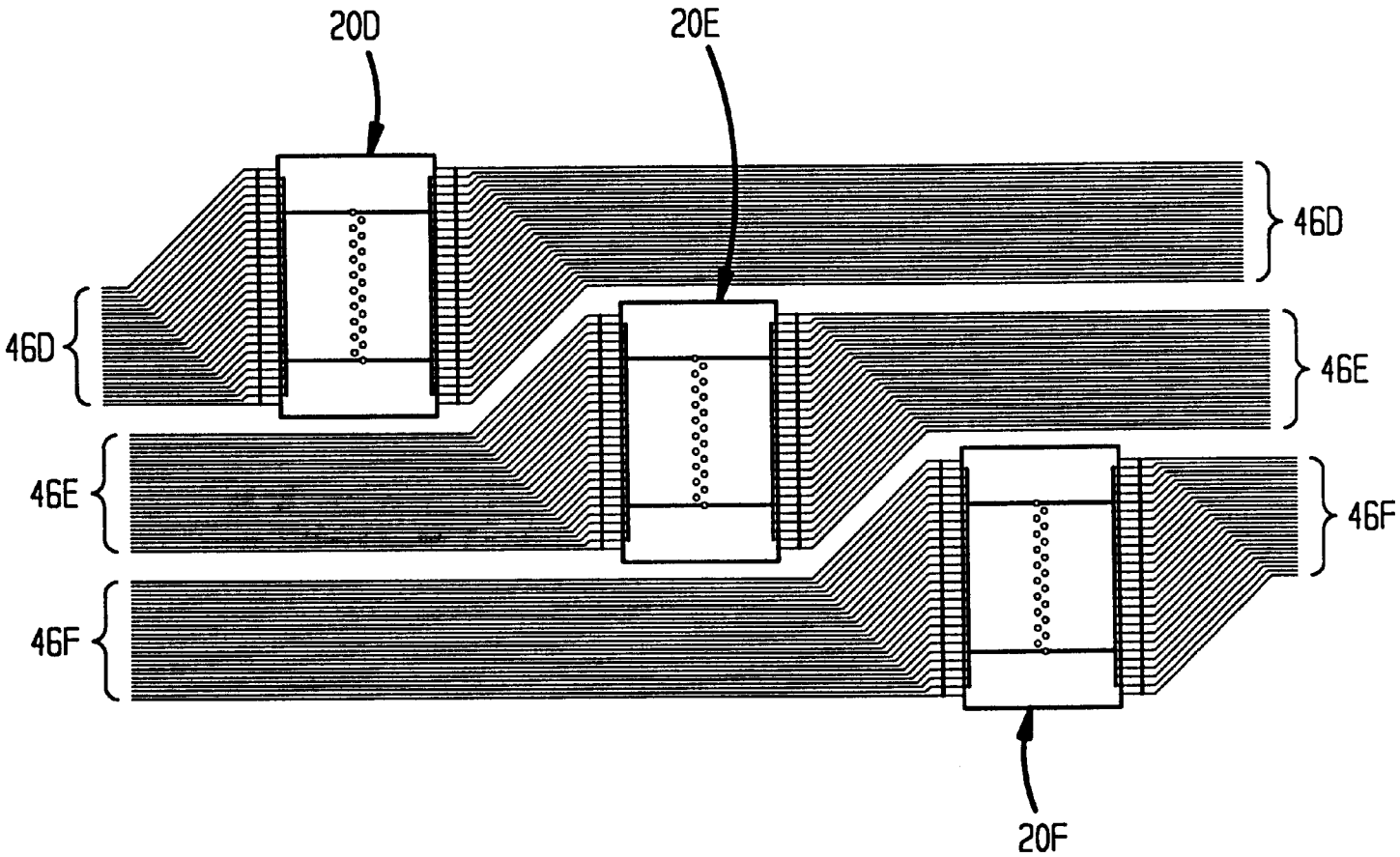
FIG. 17 is a plan view, similar to FIG. 6, of a still further variation of the embodiment shown in FIG. 13, in which the electrical traces for the ink ejecting assemblies extend to opposite longitudinal sides of the housing.

FIGS. 16 and 17 illustrate respectively two additional variations of the embodiment of the invention shown ill FIGS. 13 and 14, in which all of the traces 46D, 46E and 46F extend to opposite lateral and longitudinal sides of the housing 12 in a manner similar to that shown in FIGS. 11 and 12 for the embodiment shown in FIGS. 7 and 9. Again, the relative advantages and disadvantages of these arrangements, in additional to those mentioned above regarding the diagonally aligned arrangement of the ink ejecting assemblies 20D, 20E and 20F are general the same as those set forth above with respect to the advantage;; and disadvantages of the arrangements shown in FIGS. 11 and 12.

Figure 18:
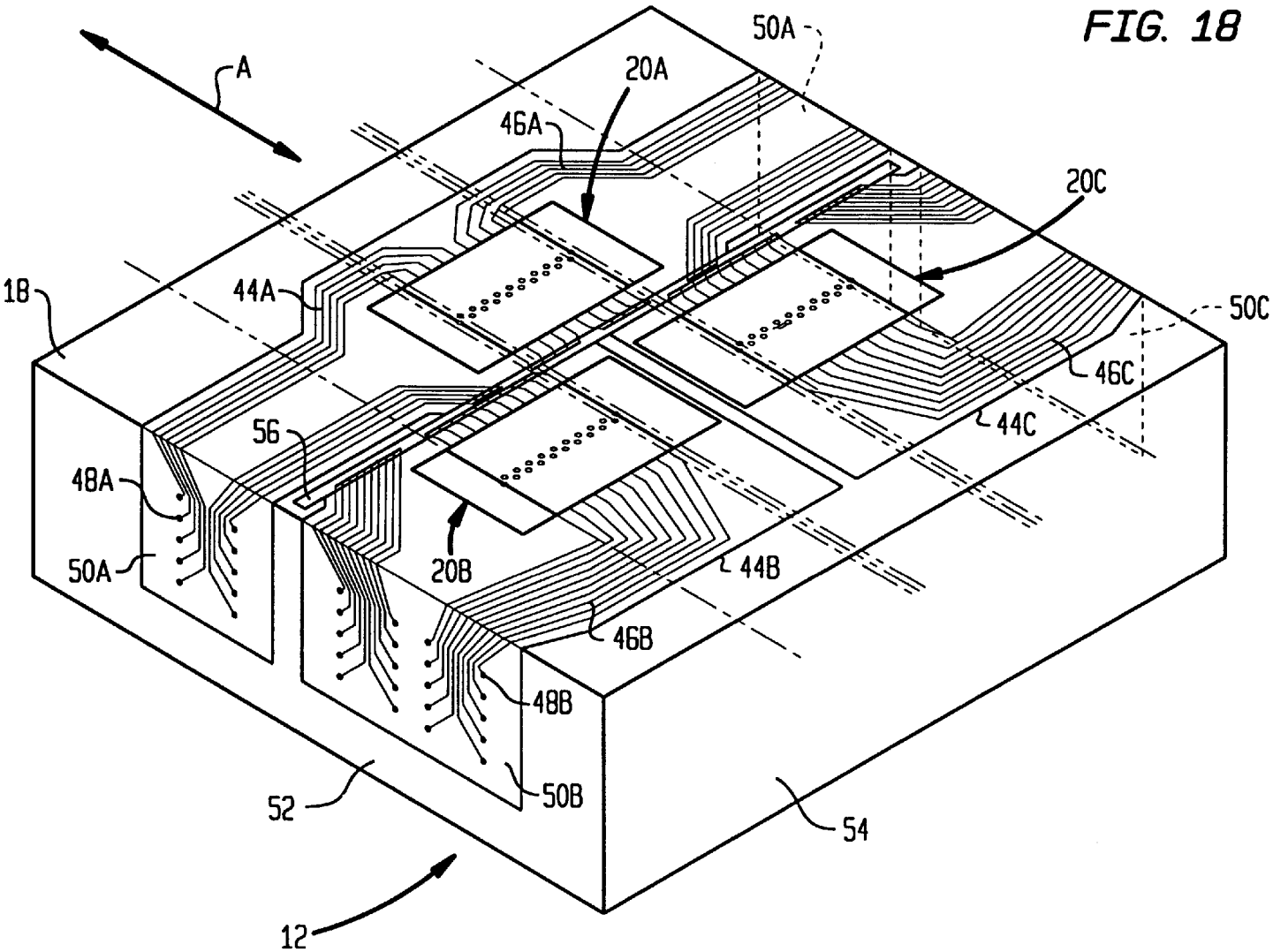
FIG. 18 is a perspective view, similar to FIG. 5, of one variation of a still further embodiment of the invention in which the number and arrangement of the ink ejecting assemblies is the same as that shown in FIG. 7, but the electrical traces for each ink ejecting assembly are formed on individual flexible circuits, adjacent portions of which are folded and inserted into a slot formed in the upper surface portion of the housing, and extend to opposite lateral sides of the housing.
Figure 19:
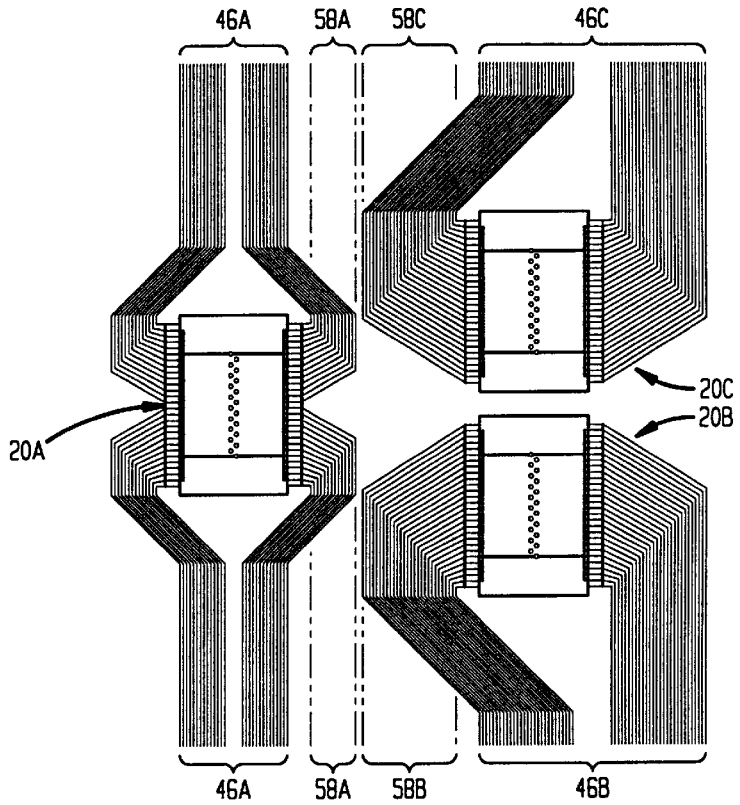
FIG. 19 is a plan view, similar to FIG. 6, of the traces of the ink ejecting assemblies shown in FIG. 18 if they were laid out on the face of the housing in a full flat pattern.
Figure 19A:
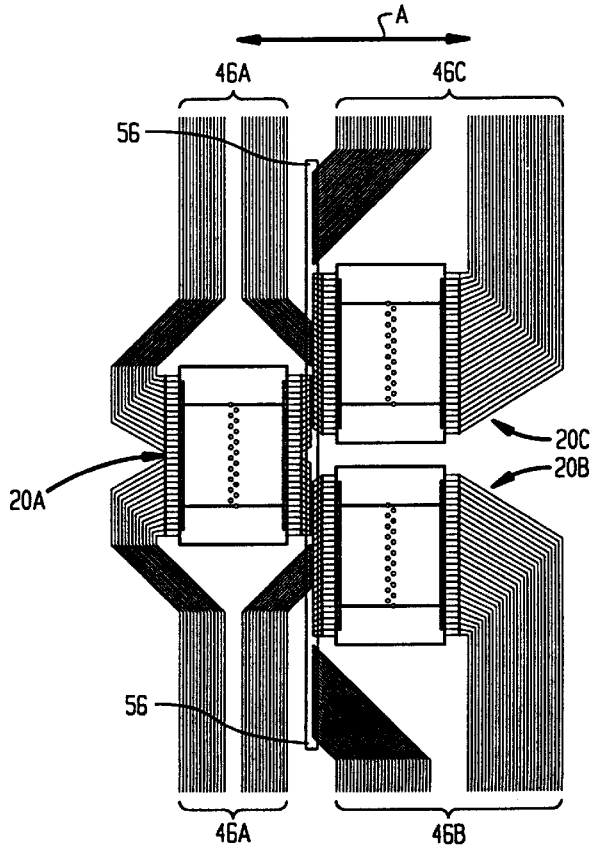
FIG. 19A is a plan view, similar to FIG. 6, of the trace. pattern of the variation of the embodiment illustrated in FIG. 18 when portions of the flexible circuits are folded and inserted into the slot formed in the upper surface portion of th(e housing.

FIGS. 18 and 19A illustrate one variation of a still further embodiment of the present invention which is similar to the embodiments illustrated in FIGS. 7 and 9 with respect to the laterally and longitudinally offset arrangement of the ink ejecting assemblies, but in which there are individual flexible circuits for each ink ejecting assembly rather than one flexible circuit for the three ink ejecting assemblies of the previous embodiment, and further that there is a laterally extending slot formed formed in the upper face of the print head housing into which portions of the flexible circuits are inserted in order to minimize the amount of space required on the face of the print head housing for the individual flexible circuits.

Thus, as best seen in FIG. 18, there are three ink ejecting assemblies 20A, 20B and 20C arranged in the same laterally and longitudinally and laterally offset arrangement shown in FIGS. 7 and 9, and which correspond in every detail to the ink ejecting assemblies 20A, 20B and 20C, including the extent of the laterally offset arrangement of the ink ejecting assemblies 20B and 20C with respect to each other and jointly with respect to the ink ejecting assembly 20A so that the arrays of nozzles 28A, 28B and. 28C form a continuous line to print a continuous image during a single pass of relative motion between the print head 10 and the image receiving medium. A major difference from the previous embodiment, however, is that each ink ejecting assembly 20A, 20B and 20C has an individual flexible circuit 44A, 44B and 44C associated therewith, rather than the traces 46A, 46B and 46C associated with each ink ejecting assembly being incorporated into one flexible circuit, and each flexible circuit 44A, 44B and 44C contains all of the traces 46A, 46B and 46C respectively associated with the corresponding ink ejecting assemblies 20A, 20B and 20C. Also, each flexible circuit 44A, 44B and 44C has its own contact pad 50A, 50B and 50C which contain respectively the contacts 48A, 48B and 48C for each of the ink ejecting assemblies. In the arrangement shown in FIG. 18, the traces 46A, 46B and 46C for the corresponding ink ejecting assemblies are laid out in a patters similar to that shown in FIG. 11 in that the traces 46A extend to contact pads 50A disposed on opposite lateral sides of the housing 12, the traces 46B all extend to a contact pad 50B on the lateral side 52 of the housing, and the traces 46C Extend to a contact pad 50C disposed on the opposite lateral side of the housing.

It will also be seen that the upper surface 18 of the housing 12 is provided with an elongate slot 56 which extends along a major portion of the surface 18 from one lateral side to the other, and a portion of each flexible circuit 44A, 44E and 44C extending along the inner edges thereof, that is the edge portion that is proximate to the slot 56, is folded downwardly into the slot 56. With reference to FIG. 19, it will be seen that the width of the inner edge portion of the flexible circuit 44A that is folded into the slot 56 is represented by the brackets 58A, the width of the inner edge portion of the flexible circuit 44B that is folded into the slot 56 is represented by the bracket 58B and the width of the inner edge portion of the flexible circuit 44C that is folded into the slot 56 is represented by the bracket 58C.

The principle advantage of this arrangement is that it affords an ink ejecting assembly pattern that occupies the least amount of space on the surface 18 of the print head housing 12 of any of the arrangements herebefore shown and described. This can best be appreciated by comparing FIGS. 19 and 19A, which illustrate respectively the amount of space that would be required if the three flexible circuits 44A, 44B and 44C were laid out flat on the surface 18, and the reduced amount of space required when the inner edges of the three flexible circuits are folded into the slot 56 in the manner just described. It can be clearly seen that in FIG. 19A, the ink ejecting assemblies 20B and 20C are much closer in the longitudinal direction of relative motion represented by the line A to the ink ejecting assembly 20A than is the case with the arrangement shown in FIG. 19 where the flexible circuits 46A, 46B and 46C are shown laid out flat on the surface 18.

Another advantage of the individual flexible circuit arrangement is that if any flexible circuits are defective in manufacture, only the flexible circuit for one ink ejecting assembly must be discarded, whereas in the single flexible circuit arrangement of the previous embodiments if any part of the flexible circuit is defective, the entire flexible circuit for all three ink ejecting assemblies must be discarded. A disadvantage of this arrangement, however, is that they are more expensive to manufacture and install than the single flexible circuit.

Figure 20:
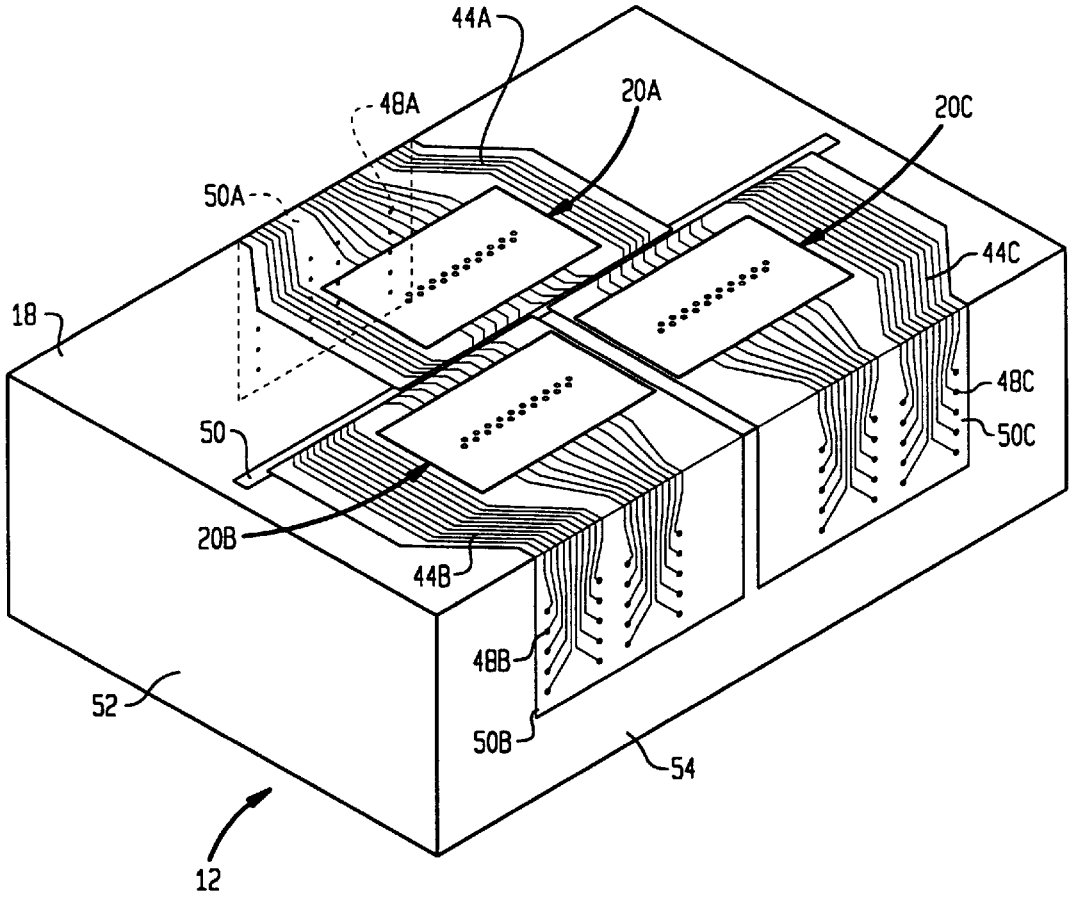
FIG. 20 is a perspective view, similar to FIG. 6, of another variation of the embodiment of the invention illustrated in FIG. 18, in which the traces extend for the ink ejecting assemblies extend to opposite longitudinal sides of the housing.
Figure 21:
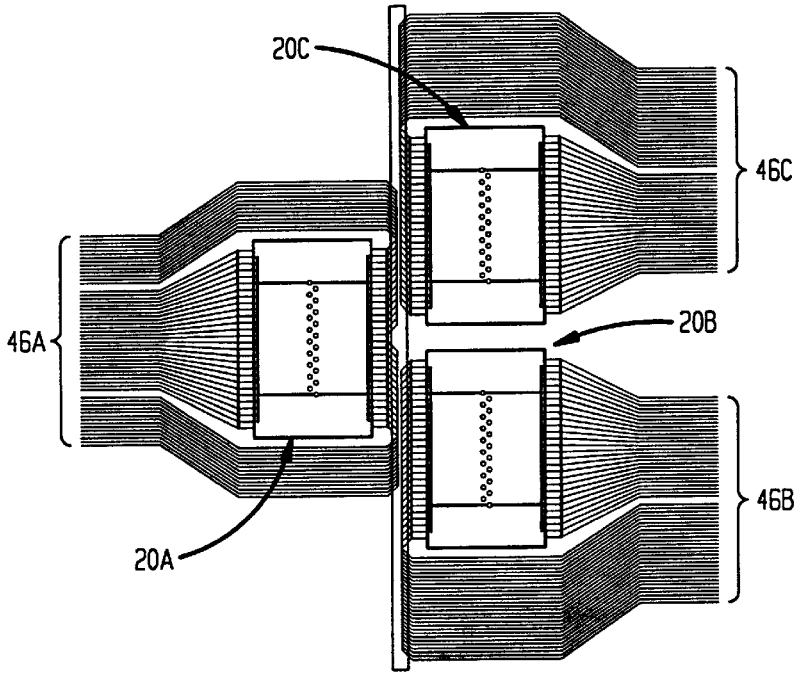
FIG. 21 is a plan view, similar to FIG. 6, of the variation of the embodiment illustrated in FIG. 20.

FIGS. 20 and 21 illustrate another variation of the embodiment illustrated in FIGS. 19 and 19A, in which includes three individual flexible circuits 44A, 44B and 44C, except that the traces for each of the ink ejection assemblies extend to opposite longitudinal sides of the housing 12 rather than to opposite lateral sides. Thus, as seen in these figures, a portion of each flexible circuit 44A, 44B and 44C extending along the inner edges thereof is folded downwardly into the slot 56, in the same manner as in the previous variation, but the traces 46B and 46C for the aligned ink ejection assemblies 20B and 20C now extend to the longitudinal edge 54 of the housing 12 and terminate in the contacts 48B and 48C located on the contact pads 50B and 50C, and the traces 46A for the ink ejection assembly 20A extend to the opposite longitudinal edge and terminate in the contacts 48A located on the contact pad 50A.

This variation combines the advantages of the individual flexible circuits 44A, 44B and 44C with portions thereof folded into the slot 56 with the advantages of having the traces extend to opposite longitudinal edges of the housing 12, both as fully explained above.

Figure 22:
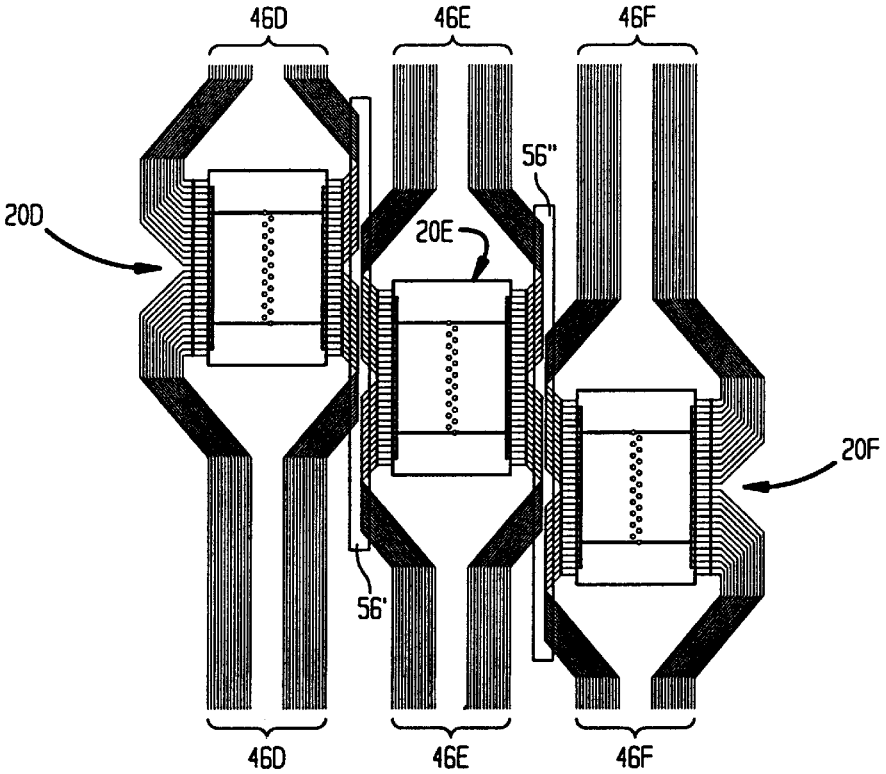
FIG. 22 is a plan view, similar to FIG. 6, of another variation of the embodiments illustrated in FIGS. 18 and 20 in which the ink ejecting assemblies are arranged in the same diagonal relationship as that first illustrated in FIG. 13, with the electrical traces extending to opposite lateral sides of the housing.
Figure 23:
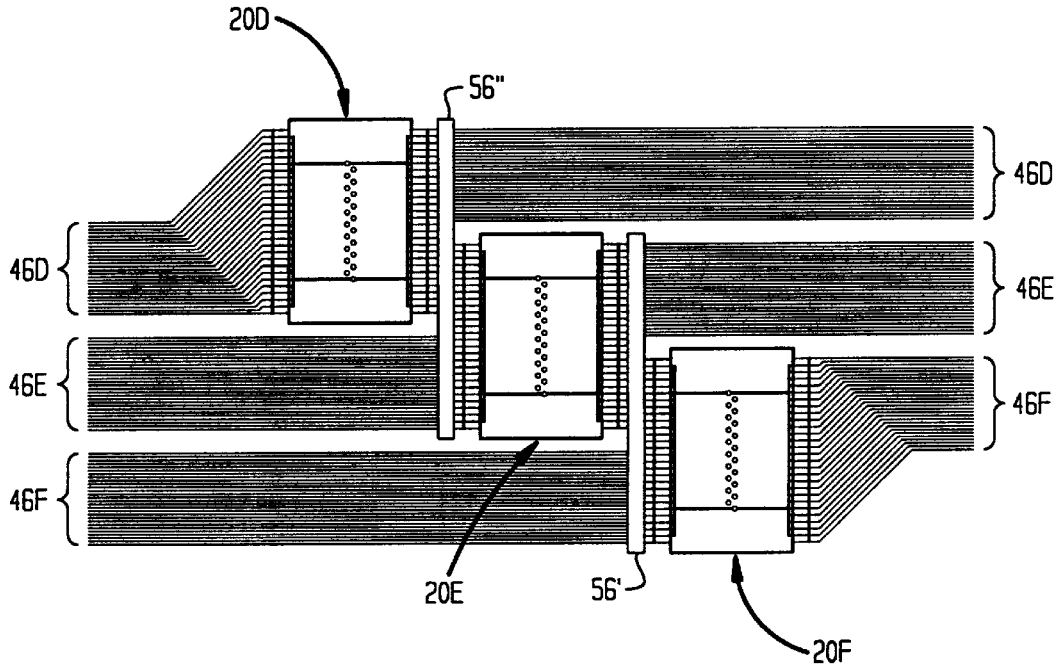
FIG. 23 is a plan view, similar to FIG. 6, of still another variation of the embodiments illustrated in FIGS. 18 and 20 in which the ink ejecting assemblies are arranged the same as in FIG. 22, but with the electrical traces extending to opposite longitudinal sides of the housing.

FIGS. 22 and 23 illustrate two additional variations of the modification shown in FIGS. 18 and 19 in which the ink ejection assemblies are disposed in the same diagonally aligned relationship as first shown in FIG. 13, combined with inner portions of the individual flexes (as shown in FIGS. 18 and 20) being inserted into slots in the manner shown in FIGS. 18 and 20. Thus, in FIG. 22, the ink ejection assemblies 20D, 20E and 20F are shown in the diagonally aligned relationship, with the traces 46D, 46E and 46F extended to opposite lateral sides of the housing 12, as fully explained above. However, because the ink ejection assemblies are all offset longitudinally rather than two of them being laterally aligned as in FIG. 19, this variation requires two slots, the slot 56' accommodating the inner portions of the adjacent ink ejection assemblies 20D and 20E, and the slot 56" accommodating the inner portions of the adjacent ink ejection assemblies 20D and 20E.

The variation illustrated in FIG. 23 is substantially identical to that illustrated in FIG. 22 except that the traces for the three ink ejection assemblies extend to the opposite longitudinal sides of the housing 12. Again, the same advantages and disadvantages are applicable to the variations shown in FIGS. 22 and 23 as are those for the corresponding variations previously described for the diagonal arrangement of the ink ejection assemblies, the individual flexible circuits with inner edges disposed in the slot 56 and the traces extending to laterally and longitudinal sides respectively of the housing, all of which has been previously explained.

Figure 24:
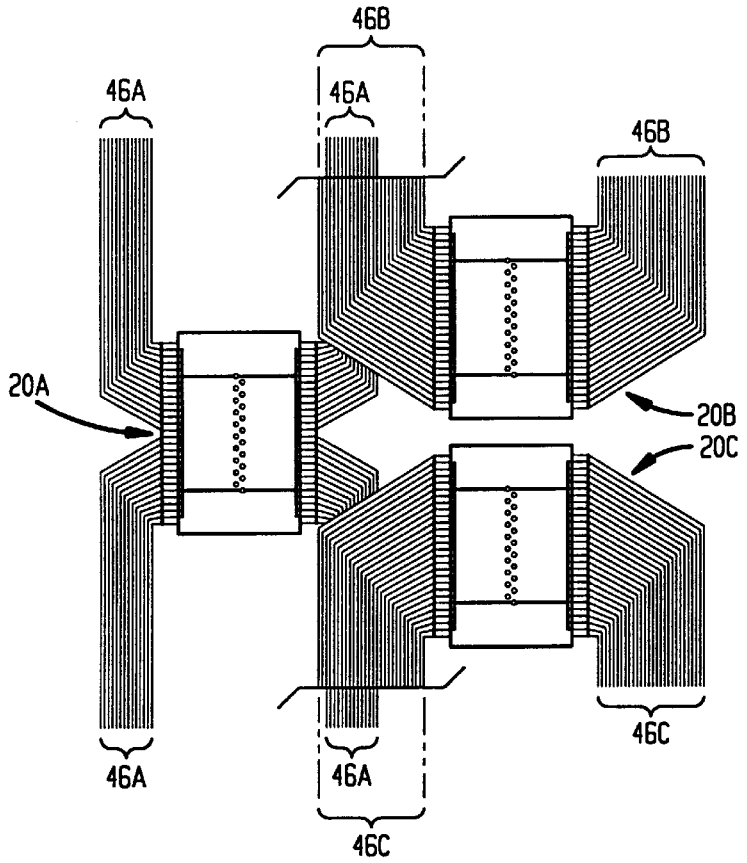
FIG. 24 is a plan view, similar to FIG. 6, of one variation of still another embodiment of the invention in which the number and arrangement of the ink ejecting assemblies, as well as the number of individual flexible circuits is the same as shown in FIG. 18, but with adjacent portions of the flexible circuits laid out in overlapping stacked arrangement, and with the electrical traces extending to opposite lateral sides of the housing.
Figure 25:
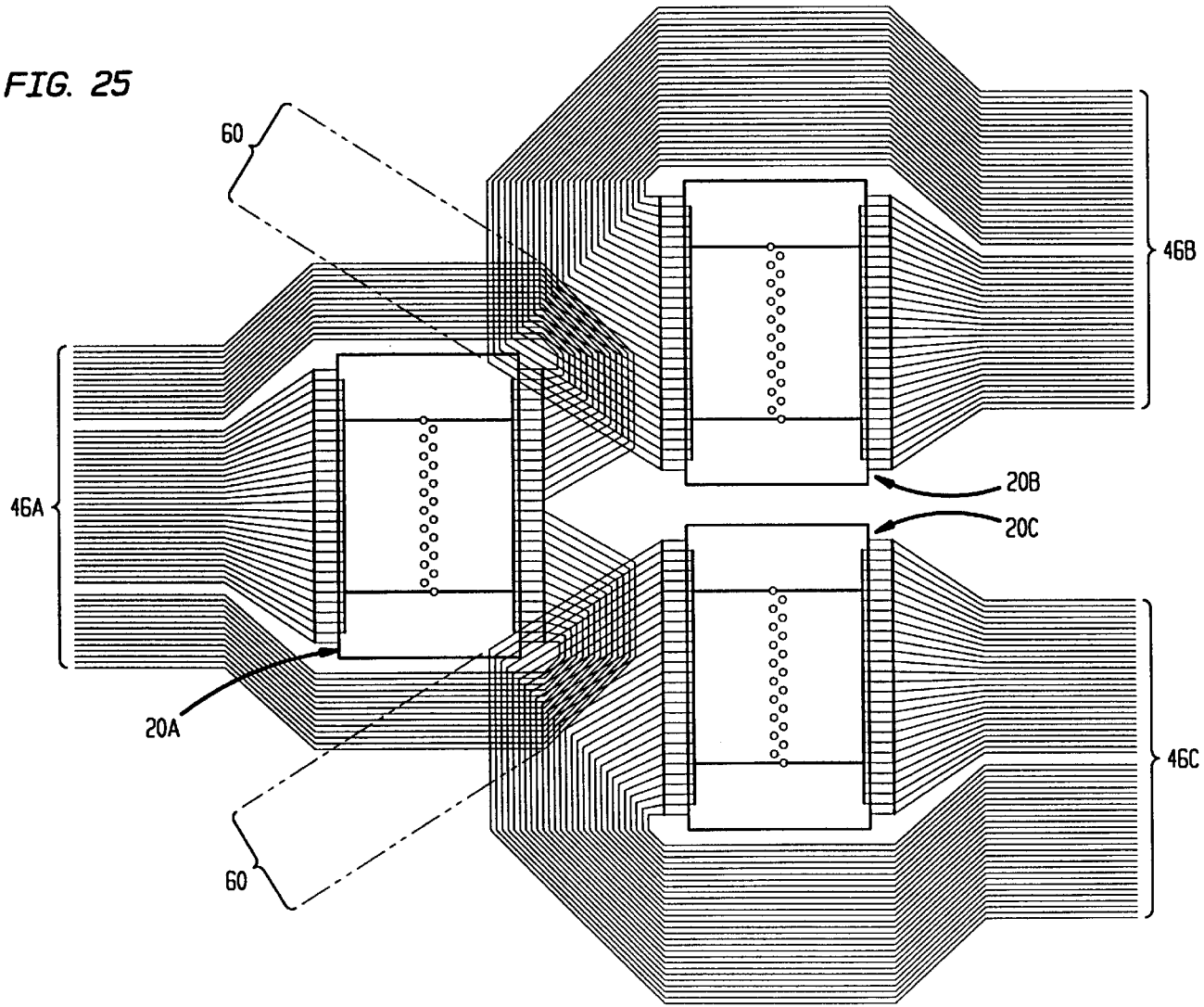
FIG. 25 is a plan view, similar to FIG. 6, of another variation of the embodiment of the invention illustrated in FIG. 24, but showing the electrical traces for the ink ejecting assemblies extending to opposite longitudinal sides of the housing.

FIGS. 24 and 25 illustrate two variations of still another embodiment of the invention in which inner portions of each of the individual traces are layered rather than being folded into a slot or slots, as the case may be. Thus, as seen in FIG. 24, again there are individual flexible circuits (in the manner shown in FIGS. 18 and 20) for each of the ink ejection assemblies 20A, 20B and 20C, which are now disposed in the laterally and longitudinally offset relationship where the ink ejection assemblies 20B and 20C are laterally aligned, and the traces 46A, 46B and 46C for all of the ink ejection assemblies extend to opposite lateral sides of the housing 12. It will be seen, however, that the two sets of traces 46A which are adjacent to the corresponding two sets of traces 46B and 46C are disposed either directly beneath or direction over the two sets of traces 46B and 46C, rather than being folded down into a slot.

FIG. 25 shown that this same layered arrangement is possible with the traces 46A, 46B and 46C all extended to opposite longitudinal sides of the housing 12, in which the dotted lines extending to the brackets 60 indicated the extent of the stacked portions of the traces 46A with the traces 46B and 46C.

The advantage of these arrangements is that it reduces the possibility of traces being broken while being inserted into the slot or slots 56, 56' and 56", as the case may be, and the housing 18 need not have slots for the flexible circuits to fit into.

It should be apparent at this point without the necessity of further illustration or description that other variations of the layered arrangement of portions of the individual flexible circuits are possible. In one such variation, the individual ink ejection assemblies are arranged as shown in FIGS. 24 and 25, but with all of the traces extending to the same lateral or longitudinal side. In two other variations, the ink ejection assemblies are arranged in the diagonally aligned relationship, either with all flexes extending to the same lateral or longitudinal sides. In two further variations, the ink ejection assemblies are arranged in the diagonally aligned relationship but the flexes extend to opposite lateral or longitudinal sides.

Figure 26:
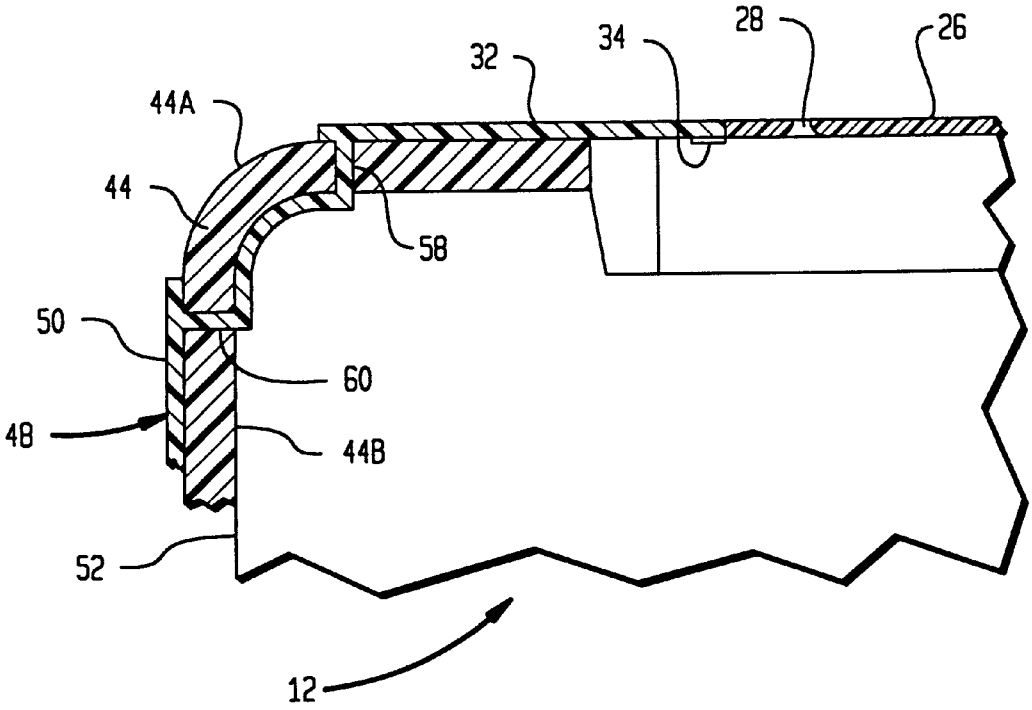
FIG. 26 is a fragmentary side sectional view through a portion of an ink ejection assembly illustrating another variation of the embodiment embodiment illustrated in FIGS. 24 and 25 in which the otherwise overlapping stacked portions of the flexible circuits extend to opposite planar sides of the substrate which support the electrical traces.

FIG. 26 illustrates a third variation of the embodiment illustrated in FIGS. 24 and 25 in which the inner portions of each of the individual traces are disposed on opposite sides of the supporting substrate, rather than being layered or folded into a slot or slots, as the case may be. FIG. 26 illustrates how this is accomplished with only a single electrical trace, since the technique of this variation can be utilized with any of the foregoing variations in which individual flexible circuits are utilized. Thus, it will be seen that a single electrical trace 32 extends from the electric contact 34 connected to the side edge of the nozzle plate 26 across a portion of one surface 44A of the flexible circuit 44 to an aperture 58 which extends through the flexible circuit 44. The electrical trace 32 extends through the aperture 58 to the opposite surface 44B of the flexible circuit 44, and continues along a portion of the surface 44B to another aperture 60, through which the electrical trace 32 extends back to the surface 44A and terminates in an electric contact 48 on one of the aforementioned contacts pads 50 secured to one of the lateral or longitudinal sides, such as the side 50, of the housing 12.

The advantages of this variation are that it facilitates rapid and easy alignment of the flexible circuit on the ink ejection assembly, and makes it easier to handle. On the other hand, it is more costly to manufacture.

It is to be understood that the present invention is not to be considered as limited to the specific embodiments described above and shown in the accompanying drawings, which are merely illustrative of the best modes presently contemplated for carrying out the invention and which are susceptible to such changes as may be obvious to one skilled in the art, but rather that the invention is intended to cover all such variations, modifications and equivalents thereof as may be deemed to be within the scope of the claims appended hereto.

I claim:

1. In an inkjet digital printing device which includes a print head having a housing which defines a reservoir for holding a supply of ink, an ink ejecting assembly affixed to one face of said housing for electing minute droplets of ink from said reservoir onto an image receiving medium having relative movement with respect to said print head, said ink ejecting assembly including a nozzle plate having an elongate array of aligned apertures which define nozzles through which the ink is ejected onto said image receiving medium, means defining a plurality of channels which communicate between said ink reservoir and said nozzles, and ink ejecting means operatively associated with each of said channels for ejecting a minute droplet of ink through said nozzles in response to an electric current being applied to said electing ink ejecting means, a plurality of adjacent electric contacts formed on opposite sides of said ink ejecting assembly and connected to said ink electing means, and a plurality of electrical traces disposed on said housing and connected to said contacts for conducting the electric current to each of said ink ejecting means, the improvement in said print head comprising:

A. a plurality of said ink ejecting assemblies affixed to said housing, each of said ink plurality of ejecting assemblies sharing a single nozzle plate and having said elongate array of aligned apertures thereon, aid ink electing assemblies being oriented on said face of said housing such that a longitudinal projection of the arrays of apertures on all of said plurality of ink ejecting assemblies forms a continuous image extending from the outer end of one outermost array of apertures to the opposite outer end of the other outermost array of apertures, and B. said electrical traces for each of said plurality of ink ejecting assemblies being disposed on said face of said housing so as to communicate with said electric contacts on said opposite sides of said plurality of ink ejecting assemblies, whereby when said print head and said image receiving medium are moved relative to one another during a printing operation of said digital printing device, an image having a height greater than about 0.25 inches can be printed during a single pass of said relative movement; and wherein:

said plurality of ink ejecting assemblies are oriented on said face of said housing in laterally and longitudinally offset relationship with respect to the direction of said relative movement between said print head and said impure receiving medium;

there are three of said ink ejecting assemblies oriented such that two of said ink ejecting assemblies are disposed adjacent one another so that said array of apertures on each of said two ink ejecting assemblies are in linear alignment across said face of said housing laterally of said direction of relative movement, and a third ink ejecting assembly disposed in offset relationship to said two ink ejection assemblies longitudinally of said direction of relative movement; and said electrical traces for each of said ink ejection assemblies extend from the plurality of electric contacts on opposite sides of said three ink ejection assemblies to a single contact pad disposed on a longitudinal side of said housing relative to said direction of relative movement.

2. In an inkjet digital printing device which includes a print head having a housing which defines a reservoir for holding a supply of ink, an ink ejecting assembly affixed to one face of said housing for ejecting minute droplets of ink from said reservoir onto an image receiving medium having relative movement with respect to said print head, said ink ejecting assembly including a nozzle plate having an elongate array of aligned apertures which define nozzles through which the ink is ejected onto said image receiving medium, means defining a plurality of channels which communicate between said ink reservoir and said nozzles, and ink ejecting means operatively associated with each of said channels for electing a minute droplet of ink through said nozzles in response to an electric current being applied to said ejecting ink ejecting means, a plurality of adjacent electric contacts formed on opposite sides of said ink ejecting assembly and connected to said ink ejecting means, and a plurality of electrical traces disposed on said housing and connected to said contacts for conducting the electric current to each of said ink ejecting means, the improvement in said print head comprising:

A. a plurality of said ink ejecting assemblies affixed to said housing, each of said ink plurality of ejecting assemblies sharing a single nozzle plate and having said elongate array aligned apertures thereon, said ink ejecting assemblies being oriented on said face of said housing such that a longitudinal projection of the arrays of apertures an all of said plurality of ink ejecting assemblies forms a continuous image extending from the outer end of one outermost array of apertures to the opposite outer end of the other outermost array of apertures arid B. said electrical traces for each of said plurality of ink ejecting assemblies being disposed on said face of said housing so as to communicate with said electric contacts on said opposite sides of said plurality of ink ejecting assemblies. whereby when said print head and said image receiving medium are moved relative to one another during a printing operation of said digital printing device, an image having a height greater than about 0.25 inches can be printed during a single pass of said relative movement; and wherein:

said plurality of ink ejecting assemblies are oriented on said face of said housing in laterally and longitudinally offset relationship with respect to the direction of said relative movement between said print head and said image receiving medium;

there are at least three of said ink ejecting assemblies oriented such that all of said ink ejecting assemblies are disposed in diagonal alignment across said face of said housing with respect to said direction of relative movement; and said electrical traces for each of said ink ejecting assemblies extend from the plurality of electric contacts on opposite of said ink ejecting assemblies to a single contact pad disposed on one longitudinal side of said housing relative to said direction of relative movement.

3. In an inkjet digital Printing device which includes a print head having a housing which defines a reservoir for holding a supply of ink, an ink ejecting assembly affixed to one face of said housing for ejecting minute droplets of ink from said reservoir onto an image receiving medium having relative movement with reset to said print head, said ink ejecting assembly including a nozzle plate having an elongate array of aligned apertures which define nozzles through which the ink is ejected onto said image receiving medium, means defining a plurality of channels which communicate between said ink reservoir and said nozzles, and ink ejecting means operatively associated with each of said channels for ejecting a minute droplet of ink through said nozzles in response to an electric current being applied to said ejecting ink ejecting means, a plurality of adjacent electric contacts formed on opposite sides of said ink ejecting assembly and connected to said ink ejecting means, and a plurality of electrical traces disposed on said housing and connected to said contacts for conducting the electric current to each of said ink ejecting means, the improvement in said print head comprising:

A. a plurality of said ink ejecting assemblies affixed to said housing, each of said ink plurality of ejecting assemblies sharing a single nozzle plate and having said elongate array of aligned apertures thereon, said ink ejecting assemblies being oriented on said face of said housing such that a longitudinal projection of the arrays of apertures on all of said plurality of ink ejecting assemblies forms a continuous image extending from the outer end of one outermost array of apertures to the opposite outer end of the other outermost array of apertures, and B. said electrical traces for each of said plurality of ink ejecting assemblies being disposed on said face of said housing so as to communicate with said electric contacts on said opposite sides of said plurality of ink ejecting assemblies, whereby when said print head and said image receiving medium are moved relative to one another during a printing operation of said digital printing device, an image having a height greater than about 0.25 inches can be Printed during a single pass of said relative movement; and wherein:

said plurality of ink ejecting assemblies are oriented on said face of said housing in laterally and longitudinally offset relationship with respect to the direction of said relative movement between said print head and said image receiving medium;

there are at least three of said ink ejecting assemblies oriented such that all of said ink ejecting assemblies are disposed in diagonal alignment across said face of said housing with respect to said direction of relative movement; and one half of said electrical traces for each of said ink ejecting assemblies extend from the plurality of electric contacts on one side of each of said ink ejecting assemblies to a single contact pad disposed on one longitudinal side of said housing, and the other half of said electrical traces for each of said ink ejecting assemblies extending from the plurality of electric contacts on the opposite side of each of said ejecting assemblies to a single contact pad disposed on the opposite longitudinal side of said housing.

4. In an inkjet digital printing device which includes a print head having a housing which defines a reservoir for holding a supply on ink, an ink ejecting assembly affixed to one face of said housing for ejecting minute droplets of ink from said reservoir onto an image receiving medium having relative movement with respect to said print head, said ink ejecting assembly including a nozzle plate having an elongate array of aligned apertures which define nozzles through which the ink is ejecting onto said image receiving medium, means defining a plurality of channels which communicate between said ink reservoir and said nozzles, and ink ejecting means operatively associated with each of said channels for ejecting a minute droplet of ink through said nozzles in response to an electric current being applied to said ejecting ink ejecting means, a plurality of adjacent electric contacts formed on opposite sides of said ink ejecting assembly and connected to said ink ejecting means, and a plurality of electrical traces disposed on said housing and connected to said contacts for conducting the electric current to each of said ink ejecting means, the improvement in said print head comprising:

A. a plurality of said ejecting assemblies affixed to said housing, each of said ink of ejecting assemblies sharing a single nozzle plate and having said elongate array of aligned apertures thereon, said ink ejecting assemblies being oriented on said face of said housing such that a longitudinal projection of arrays of apertures on all of said plurality of ink ejecting assemblies from a continuous image extending from the outer end of one outermost array of apertures to the opposite outer of the outermost array of apertures, and B. said electrical traces for each of said plurality of ink ejecting assemblies being disposed on said face of said housing so as to communicate with said electric contacts on said opposite sides of said plurality of ink ejecting assemblies, whereby when said print head and said image receiving medium are moved relative to one another during a printing operation of said digital printing device, an image having a height greater than about 0.25 inches can be printed during a single pass of said relative movement; and wherein;

said plurality of ink ejecting assemblies are oriented on said face of said housing in laterally and longitudinally offset relationship with respect to the direction of said relative movement between said printhead and said image receiving medium;

there are three of said ink ejecting assemblies oriented such that two of said ink ejecting assemblies are disposed adjacent one another so that said array of apertures on each of said two ink ejecting assemblies are in linear alignment across said face of said housing laterally of said direction of relative movement, and a third ink ejecting assembly disposed in offset relationship to said two ejecting assemblies longitudinally of said direction of relative movement, each of said ink ejecting assemblies being disposed on an individual flexible circuit;

said housing includes an elongate slot disposed between said two adjacent ink ejecting assemblies and said third ink ejecting assembly and which extends laterally along a major portion of the upper surface portion of said housing between lateral sides thereof with respect to said direction of relative movement;

one half of said electrical traces for said third ink ejecting assembly extend from one half of the plurality of electric contacts on opposite sides of each of said third ink ejecting assembly to an individual contact pad disposed on one lateral side of said housing and the other half of said electrical traces for said third ink ejecting assembly extend to an individual contact pad disposed on the other lateral side of said housing, and all of the lateral traces of said two adjacent ink ejecting assemblies extend to another individual contact pad disposed on the lateral side of said housing that is proximate to each of said two adjacent ink ejecting assemblies; and a portion of said individual flexible circuits for said two adjacent ink ejecting assemblies and said third ink ejecting assembly that are proximate to said slot are folded downwardly into said slot.

5. In an inkjet digital printing device which includes a print head having a housing which defines a reservoir for holding a supply of ink, an ink ejecting assembly affixed to one face of said housing for ejecting minute droplets of ink from said reservoir onto an image receiving medium having relative movement with respect to said print head, said ink ejecting assembly including a nozzle plate having an elongate array of aligned apertures which define nozzles through which the ink is ejected onto said image receiving medium, means defining a plurality of channels which communicate between said ink reservoir and said nozzles, and ink ejecting means operatively associated with each of said channels for ejecting a minute droplet of ink through said nozzles in response to an electric current being applied to said ejecting ink ejecting means, a plurality of adjacent electric contacts formed on opposite sides of said ink ejecting assembly and connected to said ink ejecting means, and a plurality of electrical traces disposed on said housing and connected to said contacts for conducting the electric current to each of said ink ejecting means, the improvement in said print head comprising:

A. a plurality of said ink ejecting assemblies affixed to said housing, each of said ink plurality of ejecting assemblies sharing a single nozzle plate and having said elongate array of aligned apertures thereon, said ink ejecting assemblies being oriented on said face of said housing such that a longitudinal projection of the arrays of apertures on all of said plurality of ink ejecting assemblies forms a continuous image extending from the outer end of one outermost array of apertures to the opposite outer end of the other outermost array of apertures, and B. said electrical traces for each of said plurality of ink ejecting assemblies being disposed on said face of said housing so as to communicate with said electric contacts on said opposite sides of said plurality of ink ejecting assemblies, whereby when said print head and said image receiving medium are moved relative to one another during a printing operation of said digital printing device, an image having a height greater than about 0.25 inches can be printed during a single pass of said relative movement; and wherein:

said plurality of ink ejecting assemblies are oriented on said face of said housing in laterally and longitudinally offset relationship with respect to the direction of said relative movement between said print head and said image receiving medium;

there are three of said ink ejecting assemblies oriented such that two of said ink ejecting assemblies are disposed adjacent one another so that said array of apertures on each of said two ink ejecting assemblies are in linear alignment across said face of said housing laterally of said direction of relative movement, and a third ink ejecting assembly disposed in offset relationship to said two ink ejecting assemblies longitudinally of said direction of relative movement, each of said ink ejecting assemblies being disposed on an individual flexible circuit;

said housing includes an elongate slot disposed between said two adjacent ink ejecting assemblies and said third ink ejecting assembly and which extends laterally along a major portion of the upper surface portion of said housing between lateral sides thereof with respect to said direction of relative movement;

said electrical traces for said two adjacent ink ejecting assemblies extend from the plurality of electric contacts on opposite sides of said two adjacent ink ejecting assemblies to a pair of individual contact pads for each of said two adjacent ink ejecting assemblies disposed on the longitudinal side of said housing that is proximate to said two adjacent ink ejecting assemblies, and said electric traces for said third ink ejecting assembly extend from the plurality of electric contacts on opposite sides of said third ink ejecting assembly to an individual contact pad disposed on the opposite longitudinal side of said housing; and a portion of said individual flexible circuits for said two adjacent ink ejecting assemblies and said third ink ejecting assembly that are proximate to said slot are folded downwardly into said slot.

6. In an inkjet digital printing device which includes a print head having a housing which defines a reservoir for holding a supply of ink, an ink ejecting assembly affixed to one face of said housing for ejecting minute droplets of ink from said reservoir onto an image receiving medium having relative movement with respect to said print head, said ink ejecting assembly including a nozzle plate having an elongate array of aligned apertures which define nozzles through which the ink is elected onto said image receiving medium, means defining a plurality of channels which communicate between said ink reservoir and said nozzles, and ink ejecting means operatively associated with each of said channels for ejecting a minute droplet of ink through said nozzles in response to an electric current being applied to said ejecting ink ejecting means, a plurality of adjacent electric contacts formed on opposite sides of said ink ejecting assembly and connected to said ink ejecting means, and a plurality of electrical traces disposed on said housing and connected to said contacts for conducting the electric current to each of said ink ejecting means, the improvement in said print head comprising;

A. a plurality of said ink ejecting assemblies affixed to said housing each of said ink plurality of ejecting assemblies sharing a single nozzle plate and having said elongate array of aligned apertures thereon, said ink ejecting assemblies being oriented on said face of said housing such that a longitudinal projection of the arrays of apertures on all of said plurality of ink ejecting assemblies forms a continuous image extending from the outer end of one outermost array of apertures to the opposite outer end of the other outermost array of apertures, and B. said electrical traces for each of said plurality of ink ejecting assemblies being disposed on said face of said housing so as to communicate with said electric contacts on said opposite sides of said plurality of ink ejecting assemblies, whereby when said print head and said image receiving medium are mixed relative to one another during a printing operation of said digital printing device, an image having a height greater than about 0.25 inches can be printed during a single pass of said relative movement: and wherein:

said plurality of ink ejecting assemblies are oriented on said face of said housing in laterally and longitudinally offset relationship with respect to the direction of said relative movement between said print head and said image receiving medium;

there are at least three of said ink ejecting assemblies oriented such that all of said ink ejecting assemblies are disposed in diagonal alignment across said face of said housing with respect to said direction of relative movement, each of said ink ejecting assemblies being disposed on an individual flexible circuit;

said housing includes a pair of elongate slots disposed between each adjacent pair of ink ejecting assemblies and which extend laterally along a major portion of the upper surface portion of said housing between lateral sides thereof with respect to said direction of relative movement;

one half of said electrical traces for each of said ink ejecting assemblies extend from one half of the plurality of electric contacts on opposite sides of each of said ink ejecting assemblies to an individual contact pad for each of said ink ejecting assemblies disposed on one lateral side of said housing, and the other half of said electrical traces for each of said ink ejecting assemblies extend from the other half of the plurality of electric contact on opposite sides of each of said ink ejecting assemblies to an individual contact pad for each of said ink ejecting assemblies disposed on the other lateral side of said housing; and a portion of said individual flexible circuits for each adjacent pair of ink ejecting assemblies are folded downwardly into the respective slot between each adjacent pair of ink ejecting assemblies.

7. In an inkjet digital printing device which includes a print head having a housing which defines a reservoir for holding a supply of ink, an ink ejecting assembly affixed to one face of said housing for ejecting minute droplets of ink from said reservoir onto an image receiving medium having relative movement with respect to said print head, said ink ejecting assembly including a nozzle plate having an elongate array of aligned apertures which define nozzles through which the ink is ejected onto said image receiving medium, means defining a plurality of channels which communicate between said ink reservoir and said nozzles, and ink ejecting means operatively associated with each of said channels for ejecting a minute droplet of ink through said nozzles in response to an electric current being applied to said ejecting ink ejecting means, a plurality of adjacent electric contacts formed on opposite sides of said ink ejecting assembly and connected to said ink ejecting means, and a plurality of electrical traces disposed on said housing and connected to said contacts for conducting the electric current to each of said ink ejecting means, the improvement in said print head comprising:

A. a plurality of said ink ejecting assemblies affixed to said housing, each of said ink plurality of ejecting assemblies sharing a single nozzle plate and having said elongate array of aligned apertures thereon, said ink ejecting assemblies being oriented on said face of said housing such that a longitudinal projection of the arrays of apertures on all of said plurality of ink ejecting assemblies forms a continuous image extending from the outer end of one outermost array of apertures to the opposite outer end of the other outermost array of apertures, end B. said electrical traces for each of said plurality of ink ejecting assemblies being disposed on said face of said housing so as to communicate with said electric contacts on said opposite sides of said plurality of ink ejecting assemblies, whereby when said print head and said image receiving medium are moved relative to one another during a printing operation of said digital printing device, an image having a height greater than about 0.25 inches can be printed during a single pass of said relative movement; and wherein:

said plurality of ink ejecting assemblies are oriented on said face of said housing in laterally and longitudinally offset relationship with respect to the direction of said relative movement between said print head and said image receiving medium;

there are at least three of said ink ejecting assemblies oriented such that all of said ink ejecting assemblies are disposed in diagonal alignment across said face of said housing with respect to said direction of relative movement, each of said ink ejecting assemblies being disposed on an individual flexible circuit;

said housing includes a pair of elongate slots disposed between each adjacent pair of ink ejecting assemblies and which extend laterally along a major portion of the upper surface portion of said housing between lateral sides thereof with respect to said direction of relative movement;

one half of said electrical traces for each of said ink ejecting assemblies extend from the plurality of electric contacts on one side of each of said ink ejecting assemblies to an individual contact pad for each of said ink ejecting assemblies disposed on one longitudinal side of said housing, and the other half of said electric traces for each of said ink ejecting assemblies extend from the plurality of electric contacts on the opposite side of each of said ejecting assemblies to an individual contact pad disposed on the opposite longitudinal side of said housing; and a portion of said individual flexible circuits for each adjacent pair of ink ejecting assemblies are folded downwardly into the respective slot between each adjacent pair of ink ejecting assemblies.

8. In an inkjet digital Printing device which includes a print head having a housing which defines a reservoir for holding at supply of ink, an ink ejecting assembly affixed to one face of said housing for ejecting minute droplets of ink from said reservoir onto an image receiving medium having relative movement with respect to said print head, said ink ejecting assembly including a nozzle plate having an elongate array of aligned apertures which define nozzles through which ink is elected onto said image receiving medium, means defining a plurality of channels which communicate between said ink reservoir and said nozzles, and ink ejecting means operatively associated with each of said channels for ejecting a minute droplet of ink through said nozzles in response to an electric current being applied to said ejecting ink ejecting means, a plurality of adjacent electric contacts formed on opposite sides of said ink ejecting assembly and connected to said ink ejecting means, and a plurality of electrical traces disposed on said housing and connected to said contacts for conducting the electric current to each of said ink ejecting means, the improvement in said print head comprising:

A. a plurality of said ink ejecting assemblies affixed to said housing, each of said ink plurality of ejecting assemblies sharing a single nozzle plate and having said elongate array of aligned apertures thereon, said ink ejecting assemblies being oriented on said face of said housing such that a longitudinal projection of the arrays of apertures on all of said plurality of ink ejecting assemblies forms a continuous image extending from the outer end of one outermost array of apertures to the opposite outer end of the other outermost array of apertures, and B. said electrical traces for each of said plurality of ink ejecting assemblies being disposed on said face of said housing so as to communicate with said electric contacts on said opposite sides of said plurality of ink ejecting assemblies, whereby when said print head and said image receiving medium are moved relative to one another during a printing operation of said digital printing device, an image having a height greater than about 0.25 inches can be printed during a single pass of said relative movement; and wherein:

said plurality of ink ejecting assemblies are oriented on said face of said housing in laterally and longitudinally offset relationship with respect to the direction of said relative movement between said print head and said image receiving medium;

there are three of said ink ejecting assemblies oriented such that two of said ink ejecting assemblies are disposed adjacent one another so that said array of apertures on each of said two ink ejecting assemblies are in linear alignment across said face of said housing laterally of said direction of relative movement; and a third ink ejecting assembly disposed in offset relationship to said two ink ejecting assemblies longitudinally of said direction of relative movement, each of said ink ejecting assemblies being disposed on an individual flexible circuit;

one half of said electrical traces for said third ink ejecting assembly extend from one half of the plurality of electric contacts on opposite sides of each of said third ink ejecting assembly to an individual contact pad disposed on one lateral side of said housing and the other half of said electrical traces for said third ink ejecting assembly extend to an individual contact pad disposed on the other lateral side of said housing, and all of the lateral traces of said two adjacent ink ejecting assemblies extend to another individual contact pad disposed on the lateral side of said housing that is proximate to each of said two adjacent ink ejecting assemblies; and a portion of said individual flexible circuits for said two adjacent ink ejecting assemblies and said third ink ejecting assembly that are adjacent to one another are disposed in stacked overlapping relationship.

9. The improvement as set forth in claim 8

A. wherein the electrical traces of said overlapping portions of said individual flexible circuits for said two adjacent ink ejecting assemblies and said third ink ejecting assembly are disposed on opposite sides of said individual flexible circuits, and B further including means for communicating each of said electrical traces of said overlapping portions of said individual flexible circuits from one side of said individual flexible circuits to the other.

10. In an inkjet digital printing device which includes a print head having a housing which defines a reservoir for holding a supply of ink, an ink ejecting assembly affixed to one face of said housing for ejecting minute droplets of ink from said reservoir onto an image receiving medium having relative movement with respect to said print head, said ink ejecting assembly including a nozzle plate having an elongate array of aligned apertures which define nozzles through which the ink is ejected onto said image receiving medium, means defining a plurality of channels which communicate between said ink reservoir and said nozzles, and ink ejecting means operatively associated with each of said channels for ejecting a minute droplet of ink through said nozzles in response to an electric current being applied to said ejecting ink ejecting means, a plurality of adjacent electric contacts formed on opposite sides of said ink ejecting assembly and connected to said ink ejecting means, and a plurality of electrical traces disposed on said housing and connected to said contacts for conducting the electric current to each of said ink ejecting means, the improvement in said print head comprising:

A. a plural of said ink ejecting assemblies affixed to said housing, each of said ink plurality of ejecting assemblies sharing a single nozzle plate and having said elongate array of aligned apertures thereon, said ink ejecting assemblies being oriented on said face of said housing such that a longitudinal projection of the arrays of apertures on all of said plurality of ink ejecting assemblies forms a continuous image extending from the outer end of one outermost array of apertures to the opposite outer end of the other outermost array of apertures, and B. said electrical traces for each of said plurality of ink ejecting assemblies being disposed on said face of said housing so as to communicate with said electric contacts on said opposite sides of said plurality of ink ejecting assemblies, whereby when said print head and said image receiving medium are moved relative to one another during a printing operation of said digital printing device, an image having a height greater than about 0.25 inches can be printed during a single pass of said relative movement; and wherein:

said plurality of ink ejecting assemblies are oriented on said face of said housing in laterally and longitudinally offset relationship with respect to the direction of said relative movement between said print head and said image receiving medium;

there are three of said ink ejecting assemblies oriented such that two of said ink ejecting assemblies are disposed adjacent one another so that said array of apertures on each of said two ink ejecting assemblies are in linear alignment across said face of said housing laterally of said direction of relative movement, and a third ink ejecting assembly disposed in offset relationship to said two ink ejecting assemblies longitudinally of said direction of relative movement, each of said ink ejecting assemblies being disposed on an individual flexible circuit;

said electrical traces for said two adjacent ink ejecting assemblies extend from the plurality of electric contacts on opposite sides of said two adjacent ink ejecting assemblies to a pair of individual contact pads for each of said two adjacent ink ejecting assemblies disposed on the longitudinal side of said housing that is proximate to said two adjacent ink ejecting assemblies, and said electric traces for said third ink ejecting assembly extend from the plurality of electric contacts on opposite sides of said third ink ejecting assembly to an individual contact pad disposed on the opposite longitudinal side of said housing; and a portion of said individual flexible circuits for said two adjacent ink ejecting assemblies and said third ink ejecting assembly that are adjacent to one another are disposed in stacked overlapping relationship.

11. The improvement as set forth in claim 10

A. wherein the electrical traces of said overlapping portions of said individual flexible circuits for said two adjacent ink ejecting assemblies and said third ink ejecting assembly are disposed on opposite sides of said individual flexible circuits, and B further including means for communicating each of said electrical traces of said overlapping portions of said individual flexible circuits from one side of said individual flexible circuits to the other.

* * * * *